US007494314B2

(12) United States Patent
Bares et al.

(10) Patent No.: US 7,494,314 B2
(45) Date of Patent: Feb. 24, 2009

(54) ATTACHMENT FOR SMALL SKID STEER LOADER

(75) Inventors: Mark F. Bares, Oakes, ND (US); James H. Page, Bottineau, ND (US)

(73) Assignee: Clark Equipment Company, West Fargo, ND (US)

( * ) Notice: Subject to any disclaimer, the term of this patent is extended or adjusted under 35 U.S.C. 154(b) by 89 days.

(21) Appl. No.: 10/693,617

(22) Filed: Oct. 24, 2003

(65) Prior Publication Data

US 2004/0146389 A1 Jul. 29, 2004

Related U.S. Application Data

(60) Provisional application No. 60/421,201, filed on Oct. 25, 2002.

(51) Int. Cl.
*B66C 3/00* (2006.01)

(52) U.S. Cl. ..... 414/685; 414/680; 414/703

(58) Field of Classification Search ..... 414/685, 414/680, 722, 703; 298/1 R, 2, 24; 180/19.1, 180/19.2, 19.3
See application file for complete search history.

(56) References Cited

U.S. PATENT DOCUMENTS

| | | | | | |
|---|---|---|---|---|---|
| 2,176,874 | A | * | 10/1939 | John | 180/19.1 |
| 2,624,481 | A | * | 1/1953 | Richey | 414/703 |
| 3,672,521 | A | | 6/1972 | Bauer et al. | 214/145 |
| 4,130,209 | A | | 12/1978 | Mononen | 214/140 |
| 4,725,189 | A | * | 2/1988 | Langenfeld et al. | 414/703 |
| 4,850,789 | A | | 7/1989 | Zimmerman | 414/703 |
| 5,098,252 | A | | 3/1992 | Sheesley et al. | 414/723 |
| 5,310,275 | A | | 5/1994 | Lovitt | 403/322 |
| 5,403,144 | A | | 4/1995 | Staben, Jr. | 414/697 |
| 5,415,235 | A | | 5/1995 | Gebauer | 172/273 |
| 5,486,084 | A | * | 1/1996 | Pitman et al. | 414/694 |
| 5,632,346 | A | | 5/1997 | Bobbi et al. | 172/443 |
| 5,647,721 | A | * | 7/1997 | Rohrbaugh | 414/686 |
| 5,692,850 | A | | 12/1997 | Kimble et al. | 403/24 |
| 5,732,488 | A | | 3/1998 | Smith | 37/468 |
| 5,813,152 | A | * | 9/1998 | Weight | 37/447 |
| 5,938,399 | A | | 8/1999 | Knutson | 414/722 |

(Continued)

FOREIGN PATENT DOCUMENTS

DE 19 15 432 10/1970

(Continued)

OTHER PUBLICATIONS

Construction Europe, p. 52, Tracked Dumper, published Feb. 2001.

(Continued)

*Primary Examiner*—Donald Underwood
(74) *Attorney, Agent, or Firm*—Westman, Champlin & Kelly, P.A.

(57) ABSTRACT

A loader has lift arms that are used for mounting a number of different attachments. The attachments can be mounted to the rear of the forward end of the lift arms in order to move the center of gravity of the attachment more directly over the loader frame. Various types of attachments can be used, as shown, and can be controlled to be pivoted for dumping or loading, and can be raised and lowered on the lift arms.

25 Claims, 21 Drawing Sheets

U.S. PATENT DOCUMENTS

| | | | | |
|---|---|---|---|---|
| 5,950,735 | A | 9/1999 | Godbersen | 172/439 |
| 6,035,944 | A | 3/2000 | Neuner et al. | 172/818 |
| 6,123,501 | A | 9/2000 | Pisco | 414/723 |

FOREIGN PATENT DOCUMENTS

| | | |
|---|---|---|
| GB | 757 638 | 9/1956 |
| GB | 888 530 | 1/1962 |
| GB | 1 017 195 | 1/1966 |
| GB | 1 396 684 | 6/1975 |

OTHER PUBLICATIONS

UK Hire Selects Hayter, admitted prior art. (See Power Carrier near bottom of page).

Official Communication from the European Patent Office regarding Application No. 03 777 899.0-1262 dated Dec. 19, 2005 consisting of 5 pages.

* cited by examiner

ATTACHMENT FOR SMALL SKID STEER LOADER

CROSS REFERENCE TO RELATED APPLICATIONS

This application is based on, refers to and claims priority on Provisional Patent Application Ser. No. 60/421,201 filed Oct. 25, 2002, the content of which is hereby incorporated by reference.

Reference is made to U.S. patent application Ser. No. 10/000,847 filed Nov. 1, 2001 for Low Profile Lift Arm for Small Skid Steer Loader, now U.S. Pat. No. 6,695,568, and U.S. patent application Ser. No. 10/044,104 filed Jan. 11, 2002 for Lift Arm Support and Storage Construction, now U.S. Pat. No. 6,698,114, both of which applications are incorporated by reference in their entirety.

BACKGROUND OF THE INVENTION

The present invention relates to a small loader that has a central frame, and has drive units that are shown as right and left track assemblies that are driven through suitable controls at the rear of the machine. The loader has lift arms, with attachment points at the front end that are adapted for mounting and controlling various accessories in a simplified manner to increase the versatility of the small loader.

There have been small skid steer loaders of a general type shown in this application that mount accessories such as a dumping hopper or bucket mounted to the front end of the lift arms of the machine. One such unit is manufactured by Tailor Construction Plant Limited, Quayside Industrial Park, Bates Road, Haybridge, Maldon, Essex Chelmsford, CM9 5FA United Kingdom. The model A.V.T. 500 track carrier has a dumping bucket on the front of loader arms, which require a substantial amount of linkage for operation.

SUMMARY OF THE INVENTION

The present invention relates to supports for attachments for mounting on the front end of lift arms of a small loader on a simplified linkage, utilizing the existing lift arm cylinders and existing actuators on the loader. One attachment is a dumping hopper that has an upwardly facing opening for filling and which can be dumped after loading by operating the existing cylinders to cause relative movement between the attachment mounting and other portions of the loader.

The ends of the hopper are constructed to avoid back spills, and the hopper is designed to hold in the range of 1,000 to 1,500 pounds maximum heaped capacity.

Additional attachments, such as a concrete mixer can be mounted on the lift arms and powered from a hydraulic system on the loader, and the mixer contents can be dumped using a linkage arrangement either to the loader frame or to a movable member operated by the tilt cylinder.

The mounting of a hopper and other work units or accessories mounted on linkages on the small loader make it easy to operate the loader as a motorized wheelbarrow or dumper hopper. The positioning of the hopper centers the load over the main frame of the loader, and thus such a hopper may have more capacity than a typical front end bucket, which extends forwardly from the lift arms. The existing arrangement of the attachment points on the lift arms and tilt cylinder of a small skid steer loader can be used with the linkage of the present invention.

The loader shown can be a track driven unit so it will minimize ground compaction and disturbance, and can be used in a wide range of applications.

A variety of mixing spreaders, and other work attachments can be provided as explained in detail. Subsequently, all of the attachments have mountings and linkages that use a pivoting attachment plate commonly used on skid steer loaders, and a tilt cylinder provided for pivoting the attachment plate to cause movement of the attachment for dumping contents or for placing the attachment close to the ground.

DETAILED DESCRIPTION OF THE PREFERRED EMBODIMENTS

Figure 1:
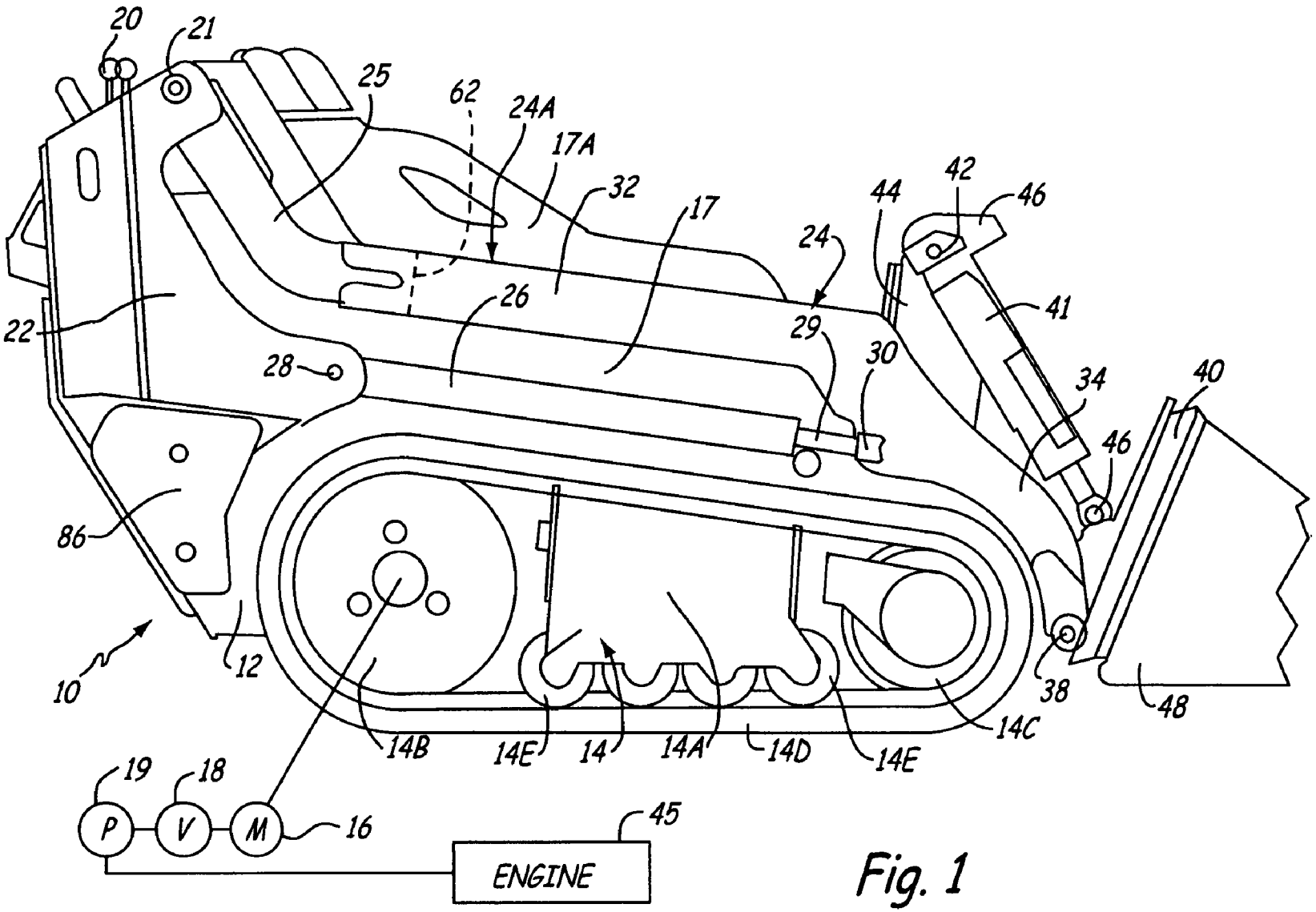
FIG. 1 is a side elevational view of a compact loader showing a conventional bucket connected to an attachment plate at the front of the lift arms.
Figure 2:
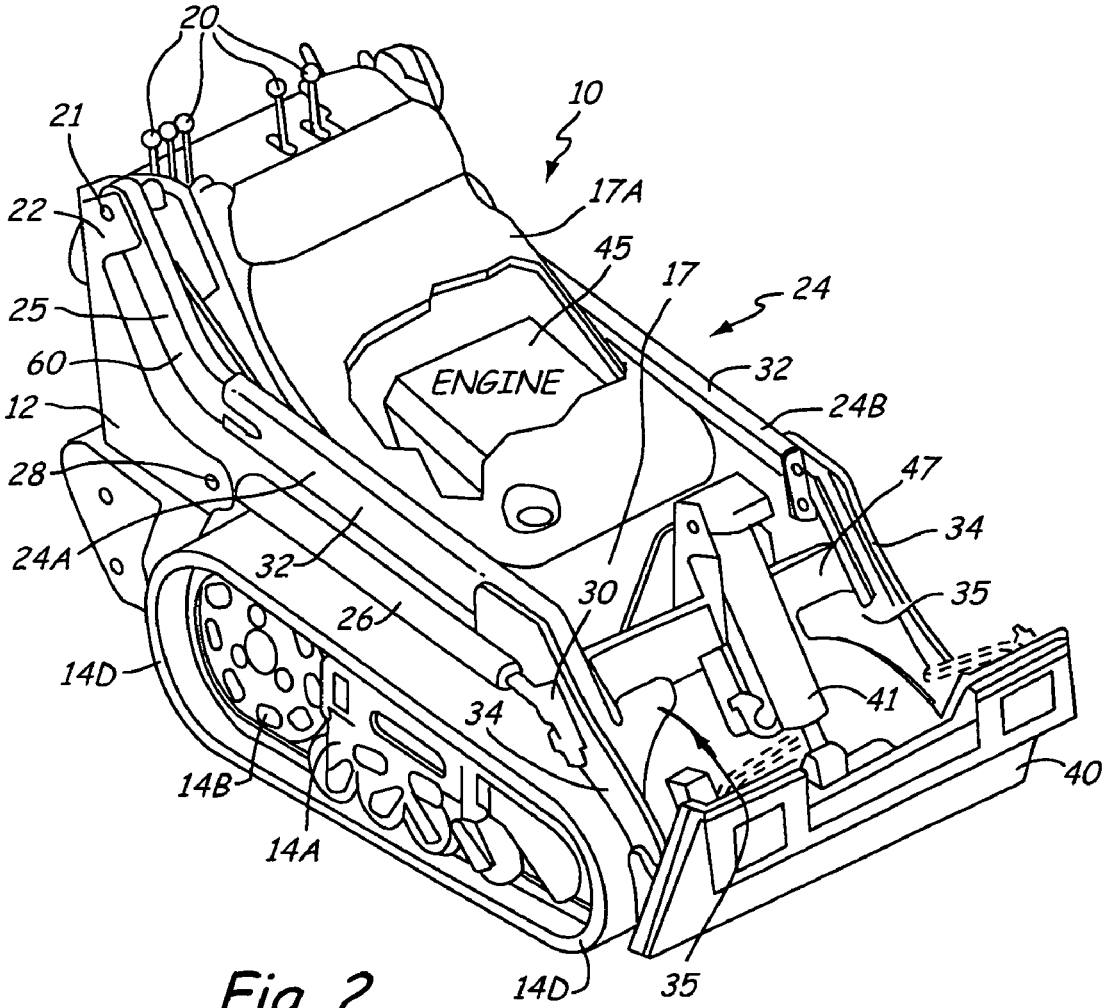
FIG. 2 is a perspective view of the loader of FIG. 1 with the bucket removed.

Referring to FIG. 1, a small loader indicated generally at 10 is a walk behind powered loader that has a body or frame 12. The frame 12 supports a track assembly 14 on each side of the loader, for propelling the loader selectively in forward or reverse directions through the use of drive hydraulic motors indicated generally at 16. Each track assembly includes a track frame 14A, a drive sprocket 14B and a front idler wheel 14C over which a track 14D is mounted. Bogie wheels 14E are also provided on the track frame for support. The drive motors 16 are operated through a pump 19 and individual valve arrangements 18 shown schematically for one motor. The valves for the motor and for the other hydraulic components are controlled by valve controls 20 at the upper end of a control panel for the loader. The pump 19 is driven by an internal combustion engine 45 mounted on the frame 12 in a housing 17 that has a cover 17A. The engine 45 is in the center portions of the loader, as shown in FIG. 2.

The frame 12 has integral upright supports 22 at the rear of the frame, which in turn pivotally mount rear ends of a lift arm assembly 24 on pivots 21 at the upper ends of the supports 22. As shown, the pivots 21 are at or near the uppermost part of the loader.

The lift arm assembly 24 includes individual lift arms 24A and 24B, on opposite sides of the frame, and each lift arm has a base end or rear plate portion 25 that inclines downwardly. The base end portion 25 of each arm 24A and 24B has a bend 60 forming a forward end that is joined to a side lift arm portion 32. The side lift arm portions extend parallel to the upper lengths of the respective track of the track assembly on the respective sides of the loader. The side arm portions 32 join forward lift arm plate portions 34 that fit around the front of the tracks, respectively.

The lift arm assembly 24 is raised and lowered with extendable and retractable double acting hydraulic cylinders or actuators 26 operating under hydraulic pressure from the pump 19 and controlled by valves forming part of the controls 20.

The cylinders 26 (there is one on each side, and only one is shown) have base ends pivotally mounted as at 28 to portions of the frame 12, and the cylinders have extendible and retractable rods 29 that have rod ends that are pivotally mounted with pins 30 to each of the lift arms 24A and 24B of the lift arm assembly 24. The lift arms include the side arms 32, and forwardly extending lift arm plate portions 34 that curve forwardly over the forward ends 36 of the drive track 14D. There are side flanges 35 spaced from the plate portions 26 to provide support for the outer ends of the lift arms. The forward ends of the lift arms curve down and pivot pins 38 are used for mounting a quick attachment plate 40 of conventional design to the lower outer ends of the forward plates of the lift arms. The quick attachment plate 40 is the type normally used with the BOBCAT® skid steer loaders made by Bobcat Company Business Unit of Ingersoll-Rand Company.

The pins 38 permit the attachment plate 40 to be pivoted about a horizontal axis by a bucket control or tilt cylinder 41 that has its base end connected as at 42 to an upright strut 44 mounted on a cross member 47 that holds the lift arms 24A and 24B together to form the lift arm assembly 24. The rod end of the actuator or cylinder 41 is connected as at 46 to a bracket on the attachment plate 40. A standard bucket 48 is shown in position on the attachment plate 40 for illustrative purposes.

Figure 3:
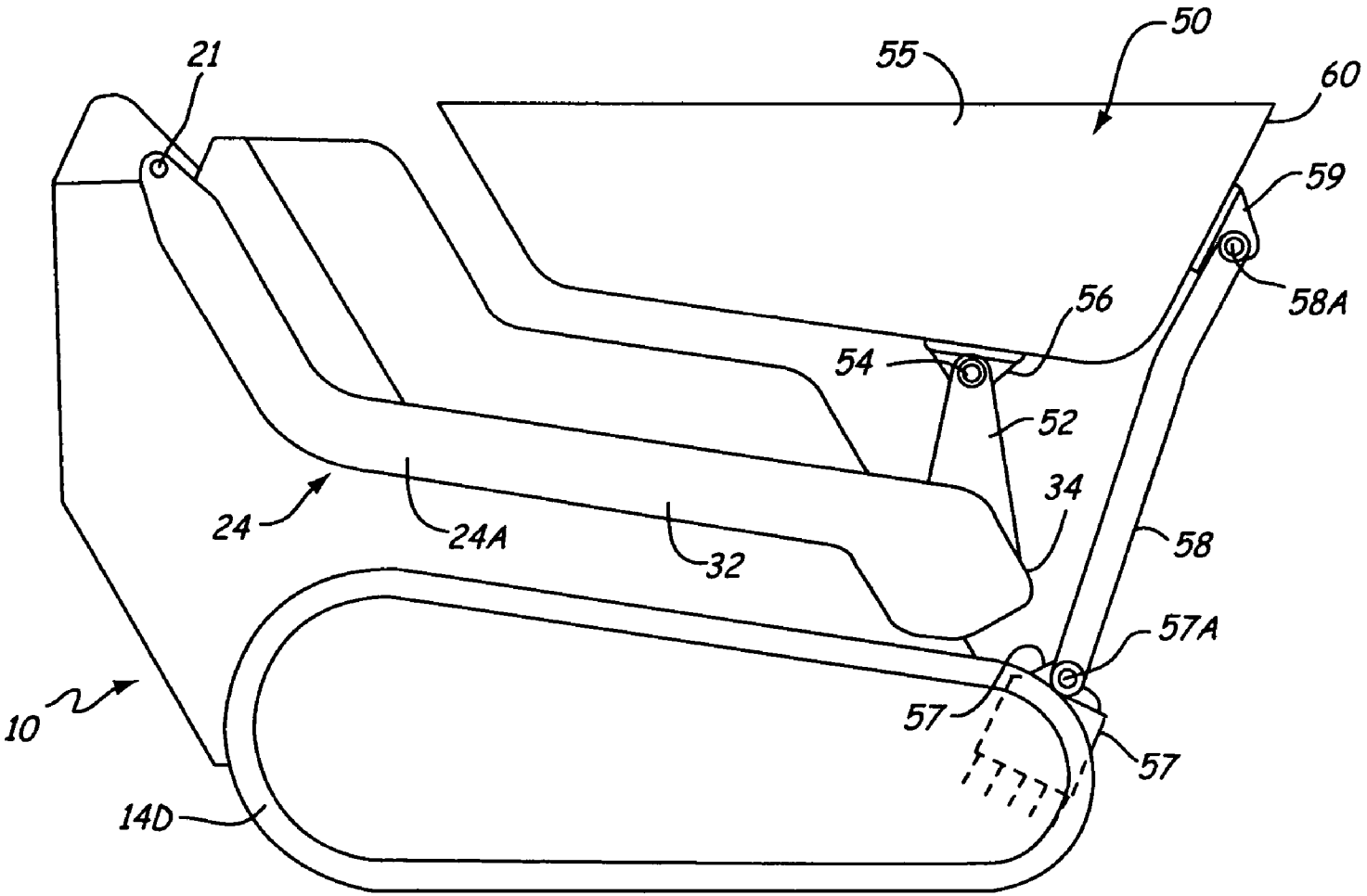
FIG. 3 is a line schematic view of a tub or hopper forming an attachment mounted in accordance with the present invention on a loader as shown at FIG. 1.
Figure 4:
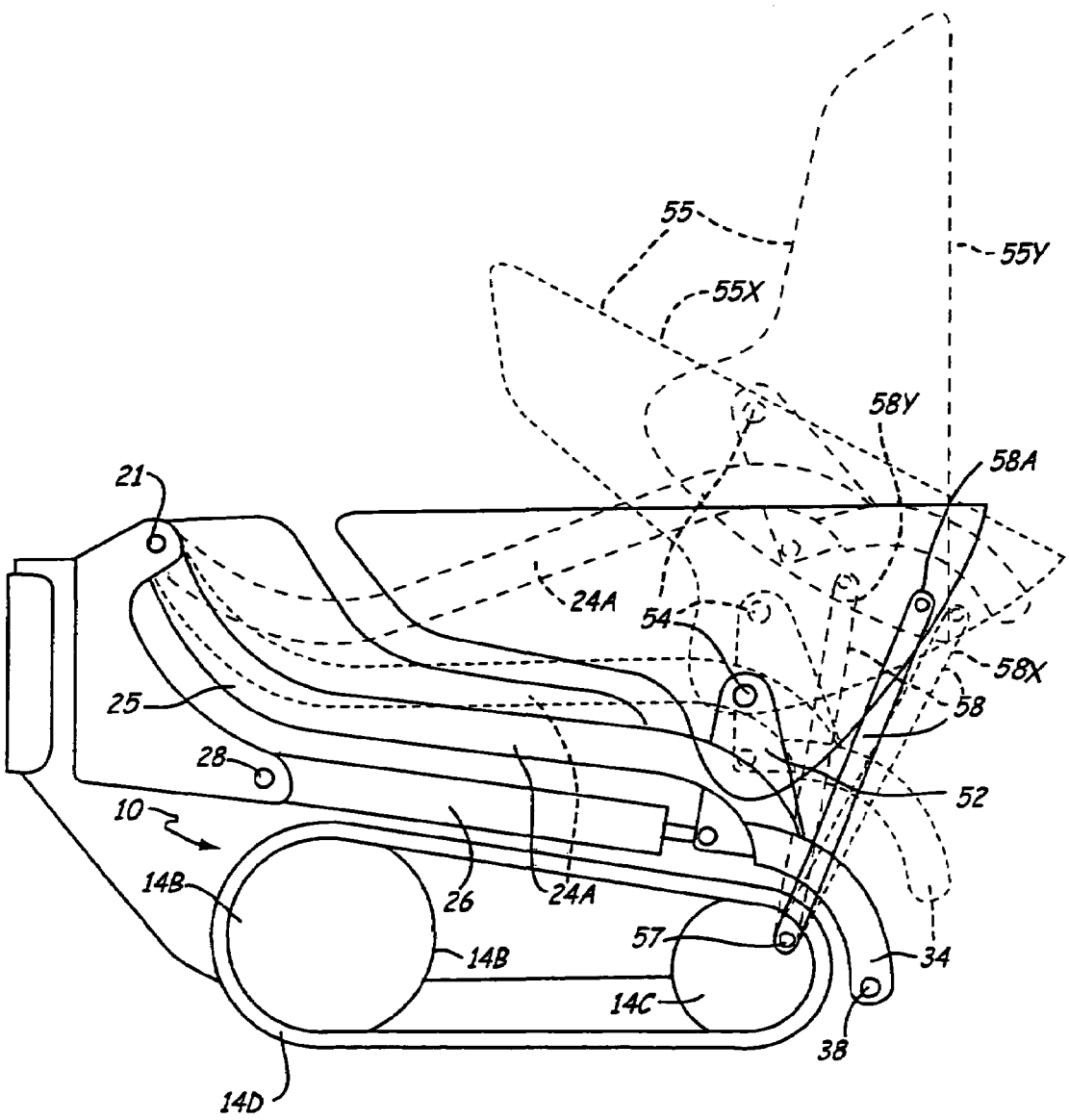
FIG. 4 is a view of a tub or hopper such as that shown in FIG. 3, showing a first form of linkage for permitting dumping of the hopper, and with dotted lines illustrating a series of hopper positions.
Figure 5:
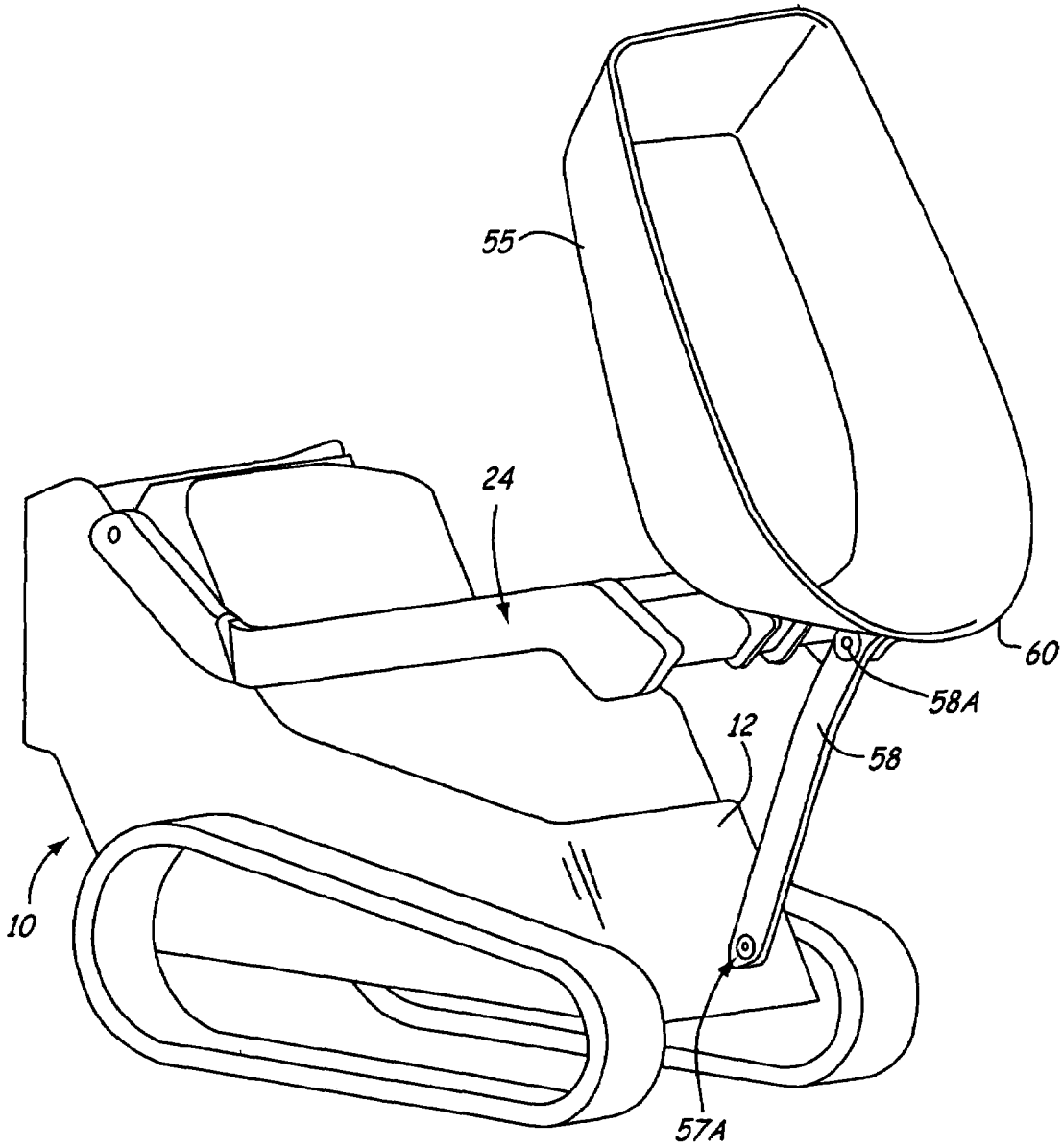
FIG. 5 is a schematic representation of the loader and hopper attachment of FIG. 3 in a dumping position.

The basic loader frame construction is normally used with a bucket, as shown. In FIGS. 3 and 4, a schematic representation of a hopper attachment mounted on the lift arms of the loader.

The lift arms 24A and 24B that form the lift arm assembly 24 is shown only schematically. The lift arm 24A is shown, and the arm pivot 21 is illustrated. The schematic showing removed the front portions of the lift arms, that is the arm sections 34. The lower arm portions that are not shown would be left in place.

A wheelbarrow hopper assembly 50 is shown mounted onto the lift arm assembly 24, and in this form of the invention, the lift arms 24A and 24B have upright struts 52 at the junction portions 34 of the arm, where they join the horizontal lift arm portions 32. A pivot pin 54 is provided for pivotally mounting a hopper or tub 55, on brackets to the top of the struts. The pivot pin 54 can also form the pin for the base of the tilt cylinder in this hopper configuration. The hopper 55 can be raised and lowered by lifting the lift arms 24. In order to provide a simplified dump arrangement, a support bracket shown schematically at 57 is fixed to the loader frame, as shown schematically in FIG. 3, and also in FIG. 4. The bracket 57 supports a pivot 57A for a link 58. The link 58 is of suitable length so that it can mount on a bracket 59 at a pivot point 58A on the front wall 60 of the wheelbarrow hopper 55.

It can be seen, particularly in FIG. 4, which shows various dotted line positions of a wheelbarrow hopper 55 as the lift arms progressively move upwardly. As illustrated in dotted lines, the link 58 will hold the front wall of the wheelbarrow hopper 55 from moving up, and the pivot 54 on struts 52 will rise, as shown in dotted lines. This will cause the hopper 55 to tilt to a front dumping position. The hopper movement is shown in two different positions in FIG. 4. The arm 24A is also shown in two positions in dotted lines, and also the corresponding dotted line positions of the link 58 are illustrated. The link 58 first moves forwardly to a position indicated at 58X, and then rearwardly to a position indicated at 58Y. Full dumping position is shown at 55Y and a partial dumping position of the hopper is shown at 55X. The link is then at position 58X.

Thus, the small loader forms a type of motorized wheelbarrow that is capable of dumping, using a simple linkage form shown in FIGS. 3 and 4.

FIGS. 5, 6, 7, and 8 illustrate another schematic representation of the loader 10, utilizing lift arm assembly 24, for dumping a hopper 55, using a fixed length link 58 secured at pivot point 57A to the mainframe 12 of the loader. Actuators for the lift arms are not shown in FIGS. 5-7, but are arranged as illustrated in the previous figures. It should be noted that in FIG. 4 the pivot point 58A is illustrated as being connected to the side walls of the hopper, rather than to a bracket as shown in FIGS. 3, 5, 6, and 7.

Figure 6:
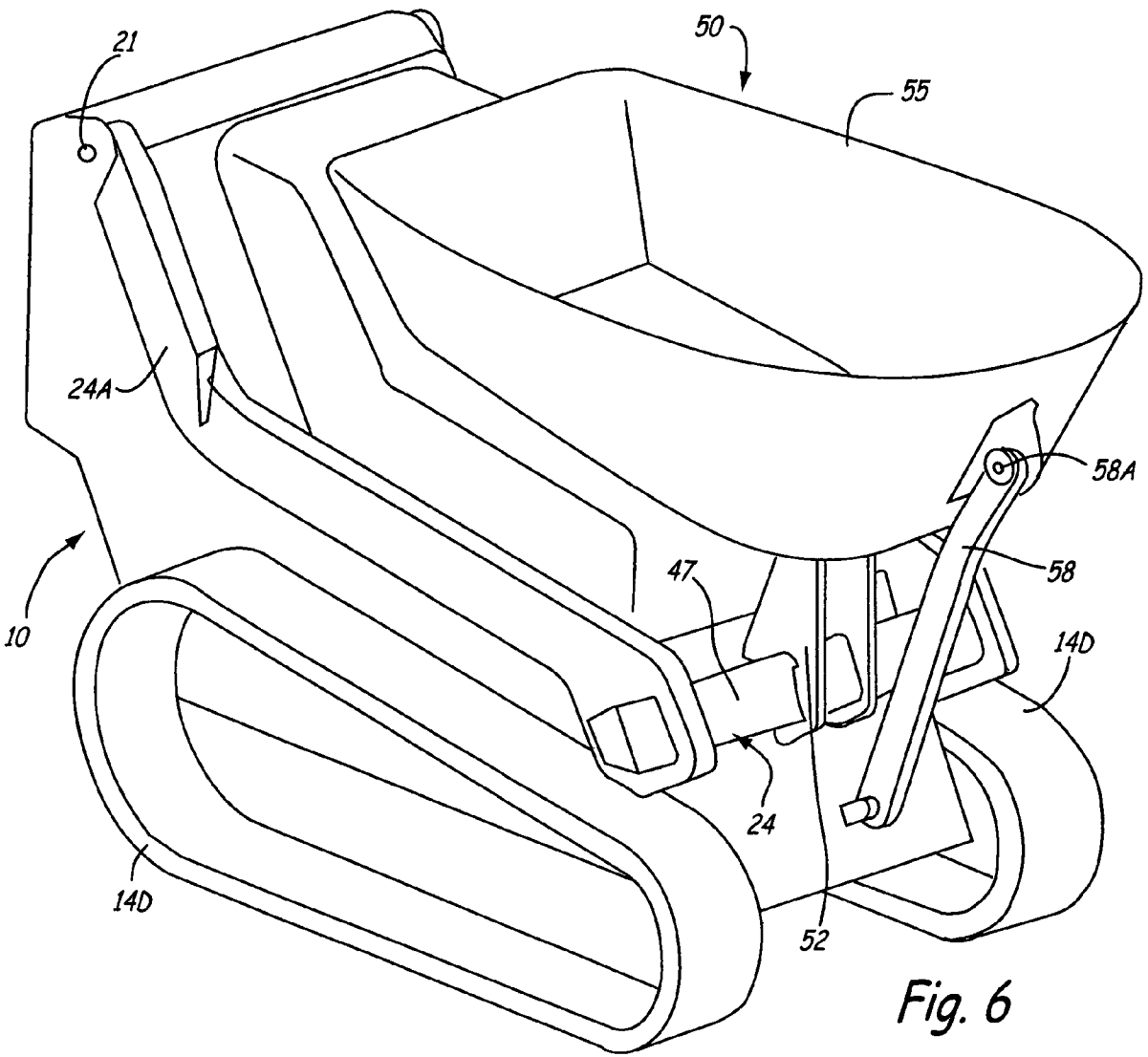
FIG. 6 is a view similar to FIG. 5 with the hopper in a loading position.
Figure 7:
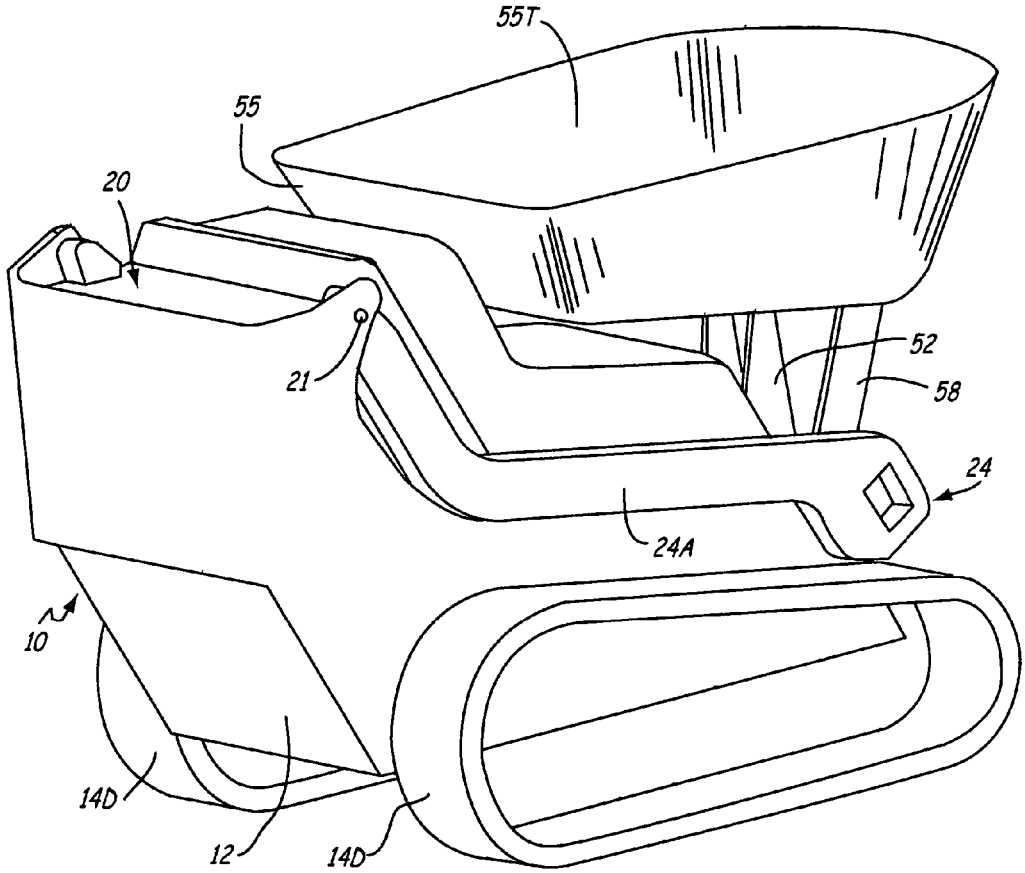
FIG. 7 is a perspective rear view of the dumping hopper shown in FIGS. 5 and 6.

It can be noted that in FIG. 6, struts or brackets 52 are relocated to be supported on the cross member 47 for the arm assembly 24 which would normally support the tilt cylinder. The tilt cylinder has been removed since it is not needed for this form of the invention. The pins for the struts or brackets 52 can use the existing base pin location or the pin can be placed on a separate bracket.

It can be seen that by lifting the lift arm assembly 24, the hopper can be dumped. When the hopper is in lowered position, it has an open top 55T, that faces upwardly and which permits filling the hopper as desired manually or with another loader. The loader can then be moved to another location and the hopper 55 dumped as desired.

Figure 8:
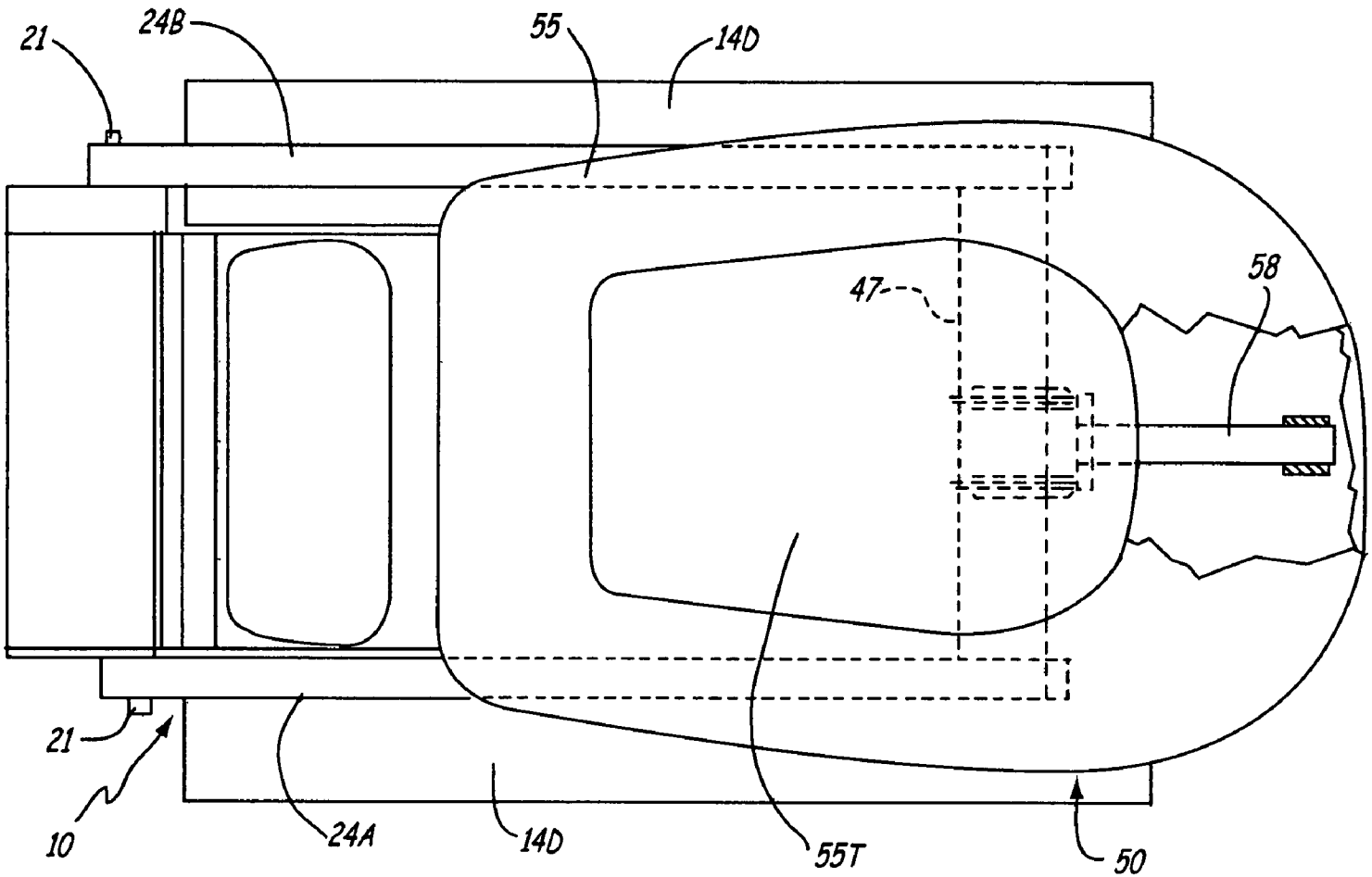
FIG. 8 is a schematic top plan view of the hopper of FIG. 7, with parts shown schematically in solid lines.

In the top view of FIG. 8, the front portion of the wheelbarrow hopper or tub 55 is broken away to show the link 58.

Figure 9:
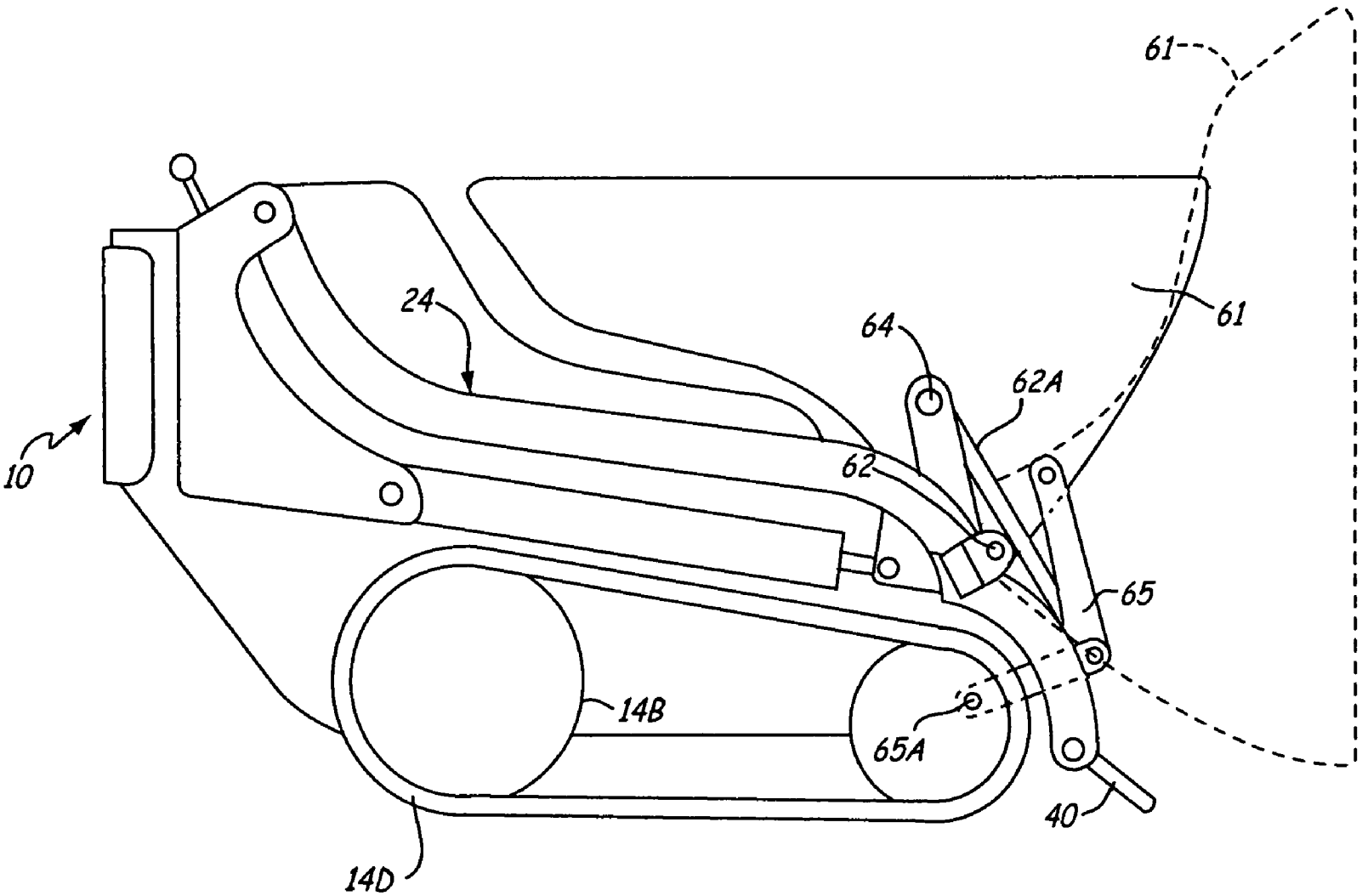
FIG. 9 is a schematic side view of a modified linkage using the existing bucket tilt cylinder and attachment plate for controlling a hopper in accordance with the present invention.

In FIG. 9, a modified form of the linkage used for dumping a hopper mounted on the loader lift arm assembly is illustrated schematically. In this form, a tub or hopper 61 is mounted on pivots 62 that are supported on the lift arm assembly, and a tilt cylinder indicated generally at 62A is utilized with a suitable linkage to tilt the hopper about the pivots 62. Extending the tilt cylinder causes the tub 61 to pivot about its pivot 62. A pivot 64, as shown for the tilt cylinder 62A, and a jointed folding linkage 65 with one end pivoted at 65A to the loader frame is utilized for controlling the pivotal movement of the tub or hopper 51 for dumping.

Alternatively, the lift arm assembly 24 can be locked in a down position, and the tilt cylinder 62A used to tilt the hopper in a desired manner.

The pivots 62 for hopper or tub are very close to the lift arm cross member such as that shown in FIG. 6 at 47. The tub can be pivoted on a short support bracket on the cross member with pivots 62 at the same level shown. A suitable linkage 65 can be attached for the tub to tilt. The single strap link 65 also can be attached to the pivoting plate 40 which is shown only schematically for pivoting the hopper. The pivot is formed with brackets right on the lift arms 24A and 24B, as shown.

FIGS. 10 through 17 show a modified linkage for mounting a wheelbarrow tub or hopper or other type of material carrier or processor attachment to the small loader. These use the basic linkage concepts illustrated in FIG. 9.

Figure 10:
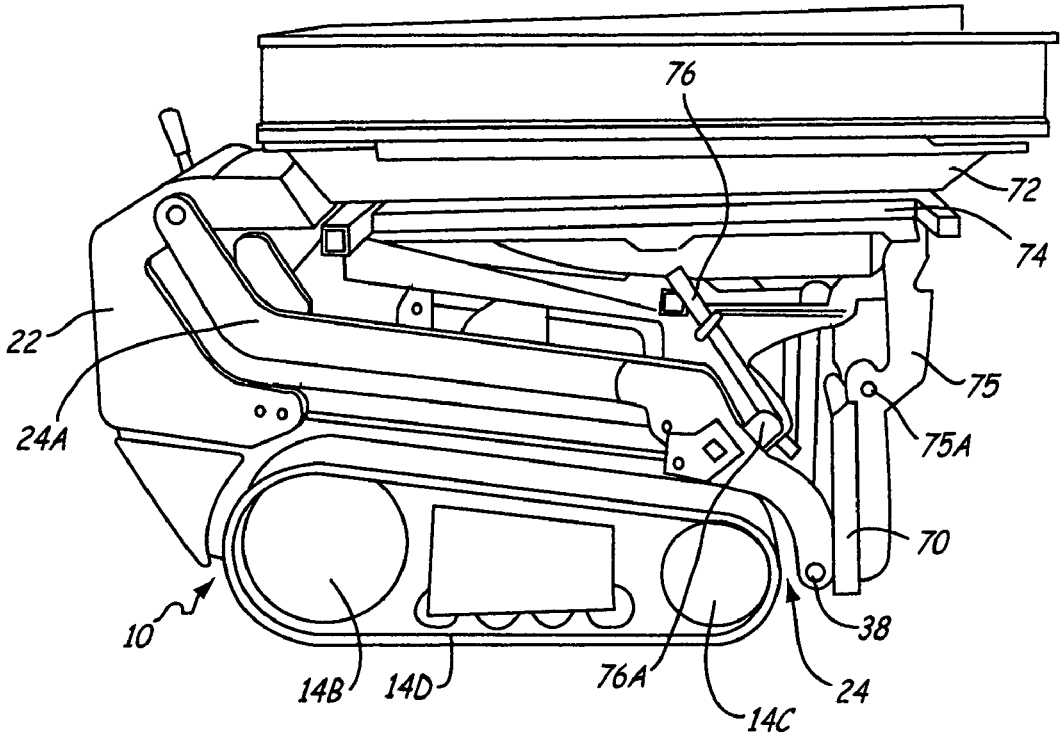
FIG. 10 is a side elevational view of a loader utilizing another form of linkage for mounting and controlling a hopper on the loader.
Figure 12:
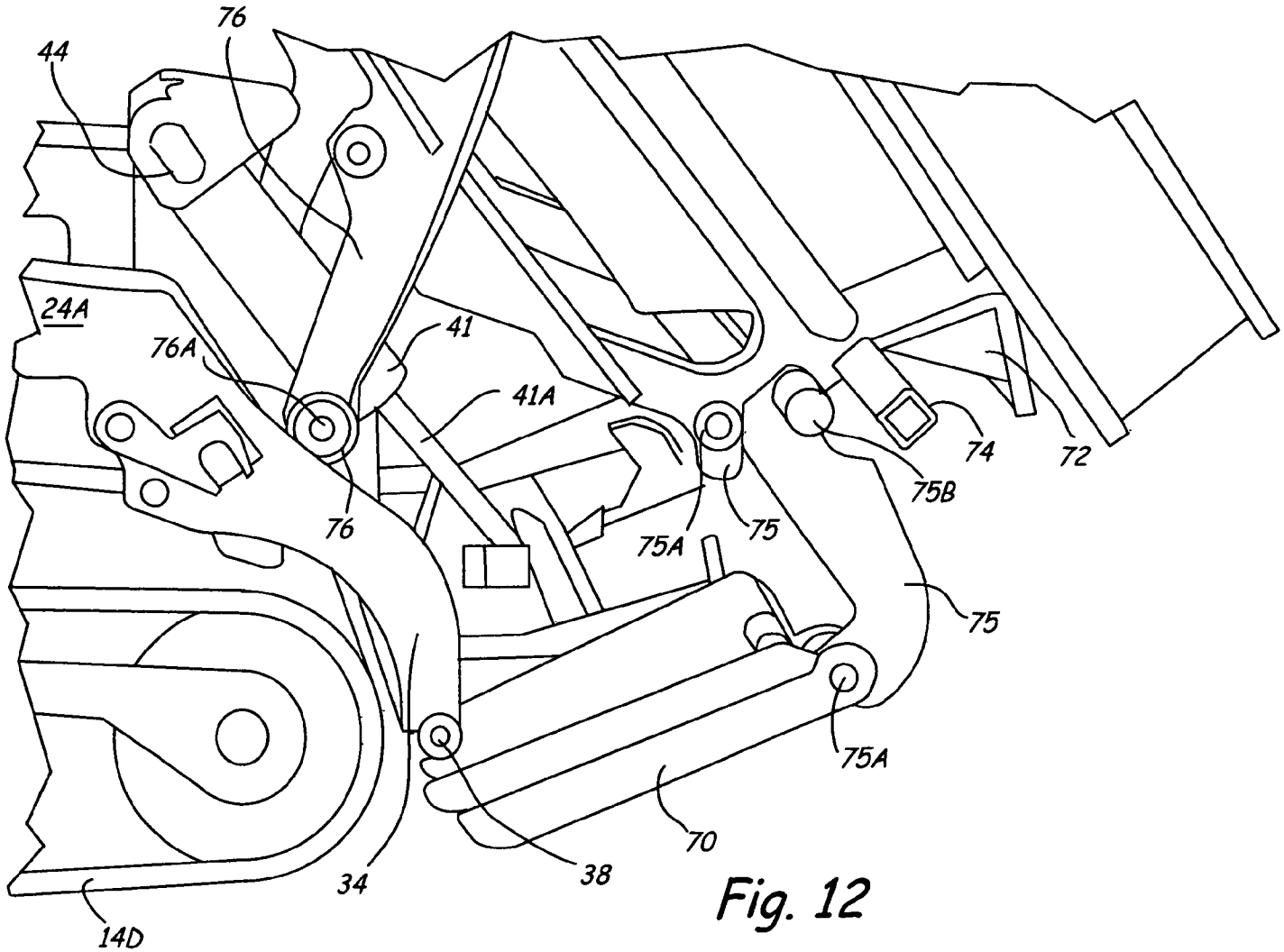
FIG. 12 is an enlarged view of the forward linkage and mounting arrangement of the hopper of FIGS. 10 and 11.

As shown in these figures, the lift arm assembly 24 and in particular the forward pivot 38 at the front ends of the lift arms supports a plate 70, which as shown is similar to the attachment plate 40, which is shown in FIGS. 1 and 2. The plate 70 can be mounted on the normal attachment plate 40, using the attachment levers conventionally provided to quickly attach and detach the plate from the loader. The tilt cylinder (shown in FIGS. 1 and 2) is used for controlling the pivoting of plate 70 (whether a separate plate or mounted on plate 40) in the same manner as that previously explained. A hopper illustrated at 72 is mounted on a suitable support frame 74, and it has links that support the hopper relative to the lift arms and the pivoting plate 70. As shown, a pair of forward links 75 are pivotally mounted as at 75A to the upper side of the plate 70 at the opposite ends of the plate. The links also are pivotally mounted, as perhaps best seen in FIG. 12, at 75B to the support frame 74. A second pair of links 76 are fixed to the support frame 74, and extend downwardly and forwardly from the frame as shown in FIG. 10, when the hoppers 72 is in its lowered position. The links 76 are pivotally mounted as at 76A to a bracket 76B on the junction portion 34 of the lift arms 24A and 24B. The bracket 76B is shown in FIG. 12. The plate 70 can be connected to the frame 74 with a single link 75 in the center of the plate 70.

The tilt cylinder 41 is also shown in FIG. 12, and its rod 41A is extended in FIG. 12, to cause the plate 70 to tilt forwardly, moving the pivot point 75A on an arc about pivot 38. This movement pulls the support frame 74 and the hopper 72 forwardly, as guided by the links 76. This causes the rear portion of the hopper 72 to tilt upwardly as the tilt cylinder 41 is extended to pivot the mounting plate 40, and causes dumping, if the forward wall portion of the hopper 72 is properly formed.

The tilt cylinder 41 is mounted onto the strut 44, in a conventional manner as shown in FIGS. 1 and 2.

Figure 11:
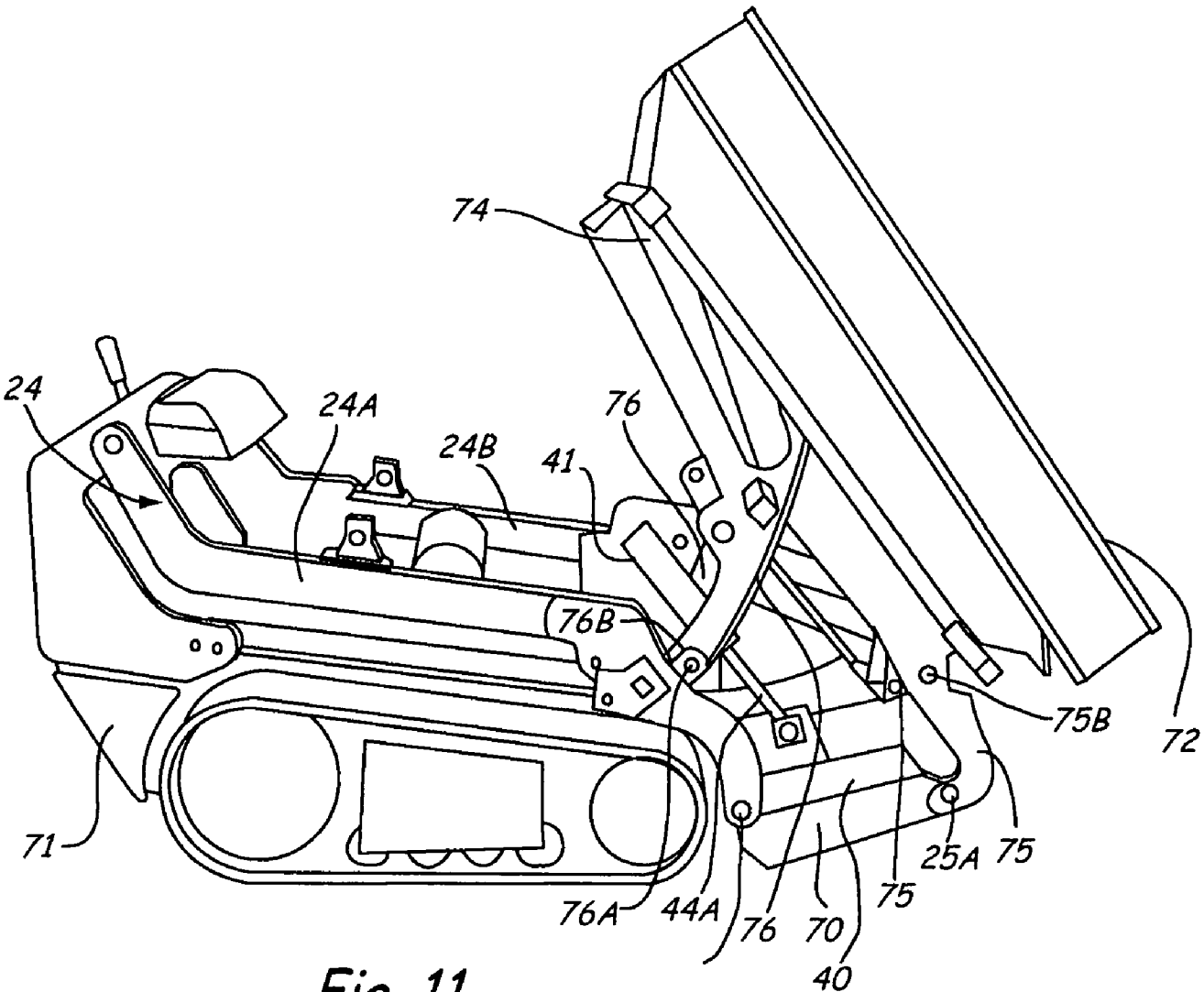
FIG. 11 is a view of the loader of FIG. 10 with a hopper in a dumping position controlled by operation of an attachment plate using an existing tilt cylinder and with the lift arms lowered.

FIG. 11 illustrates the hopper 72 being dumped when the lift arm assembly 24 is in a lowered position.

Figure 13:
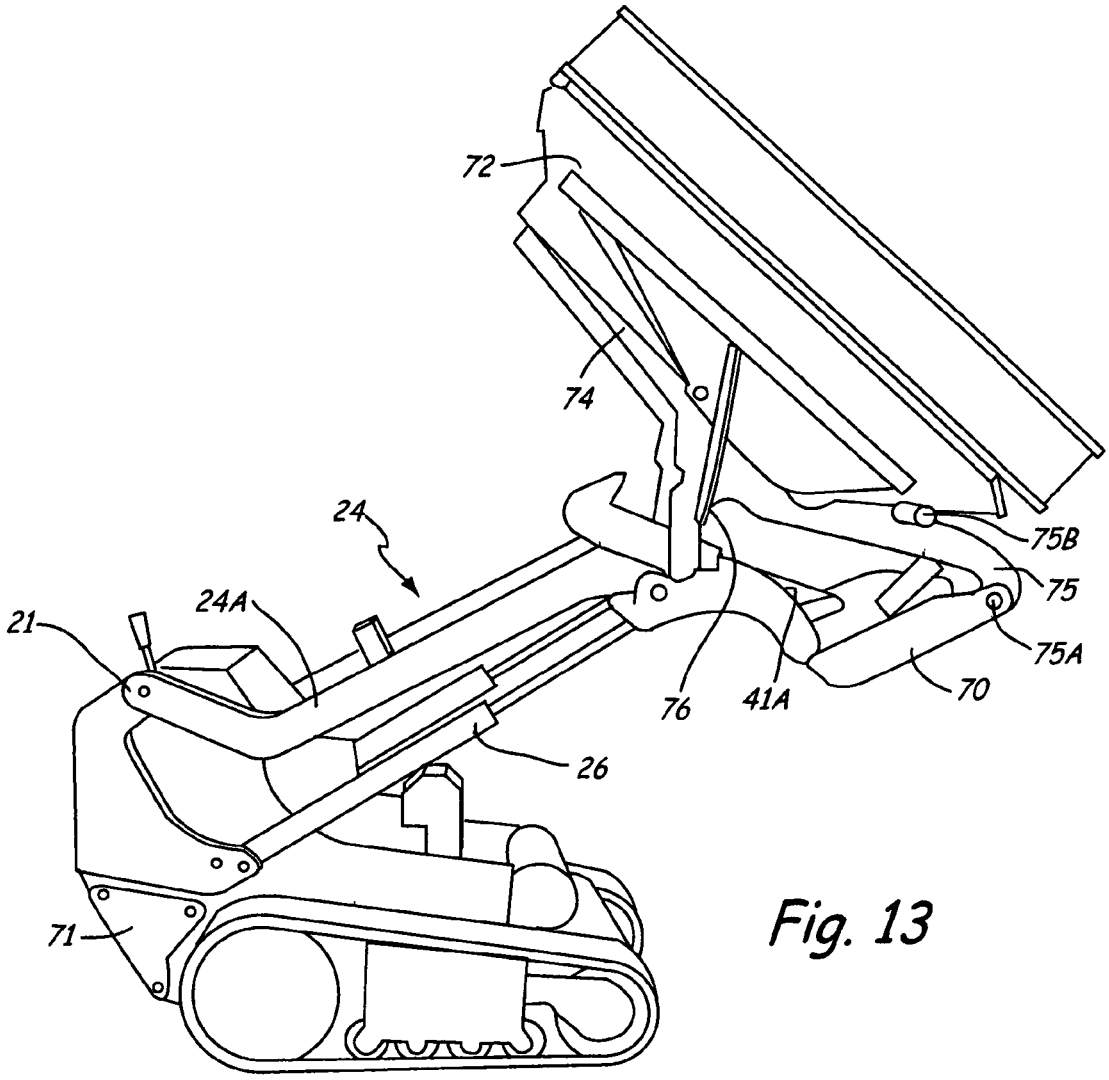
FIG. 13 is a view of the hopper of FIG. 11 with the lift arms raised.

FIG. 13 illustrates the lift arms 24 raised, with the hopper 72 still in a dumping position, so that the hopper 72 can be used for dumping into a low truck or trailer, or onto the top of a pile or over a concrete form. The amount of movement of the lift arm assembly 24 upwardly can be controlled to ensure that there is stability. It should be noted that a counterweight shown at 71 can be added to the loader in any desired position to help counterweight the weight of material in a hopper (as well as in a bucket).

A lift cylinders 26 are extended in FIG. 13 to raise the lift arms.

Figure 14:
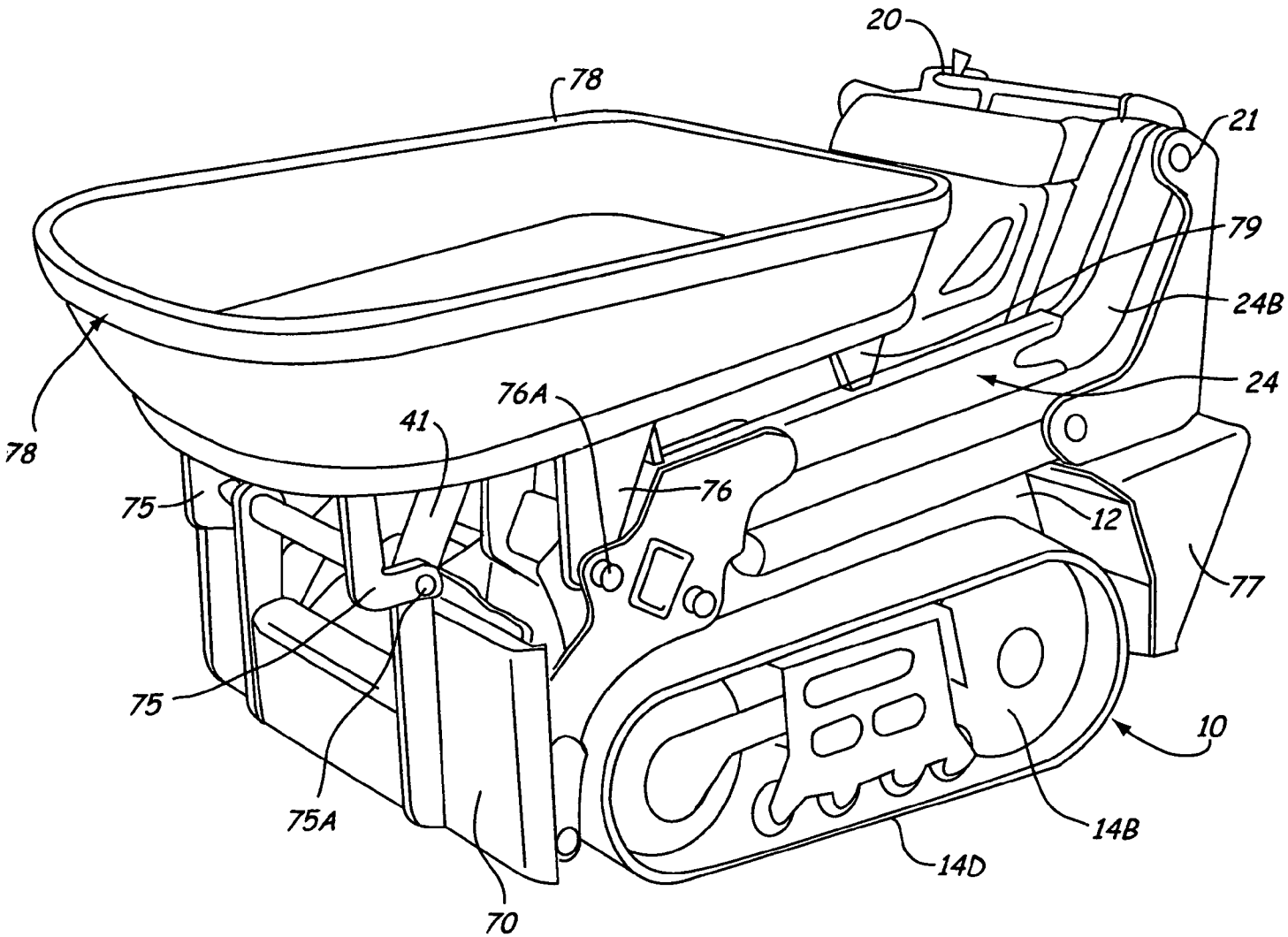
FIG. 14 is a perspective schematic view of a dumping hopper shown in FIGS. 10 and 11.

FIG. 14 illustrates a loader 10 that is labeled in a like manner to previous showings. A wheelbarrow tub or hopper 78 is supported on the lift arm assembly. Pivoting plate 70 is illustrated as well as the pivots for the lift arm assembly 24, with the arm 24B shown in FIG. 41.

The lift arm assembly 24 can be raised and lowered in the same manner as shown in FIG. 10-13, and the hopper 78 can be dumped with the tilt cylinder 41 as previously shown. The controls 20 are easily used by an operator located at the rear of the loader.

It should be noted that in FIG. 14, the rear portions of the hopper 78 are supported on stops or bumpers 79 that rest on the top of the respective lift arms 24A and 24B, for support of the hopper 78 in its loading position, which leaves the open top available for filling.

Figure 15:
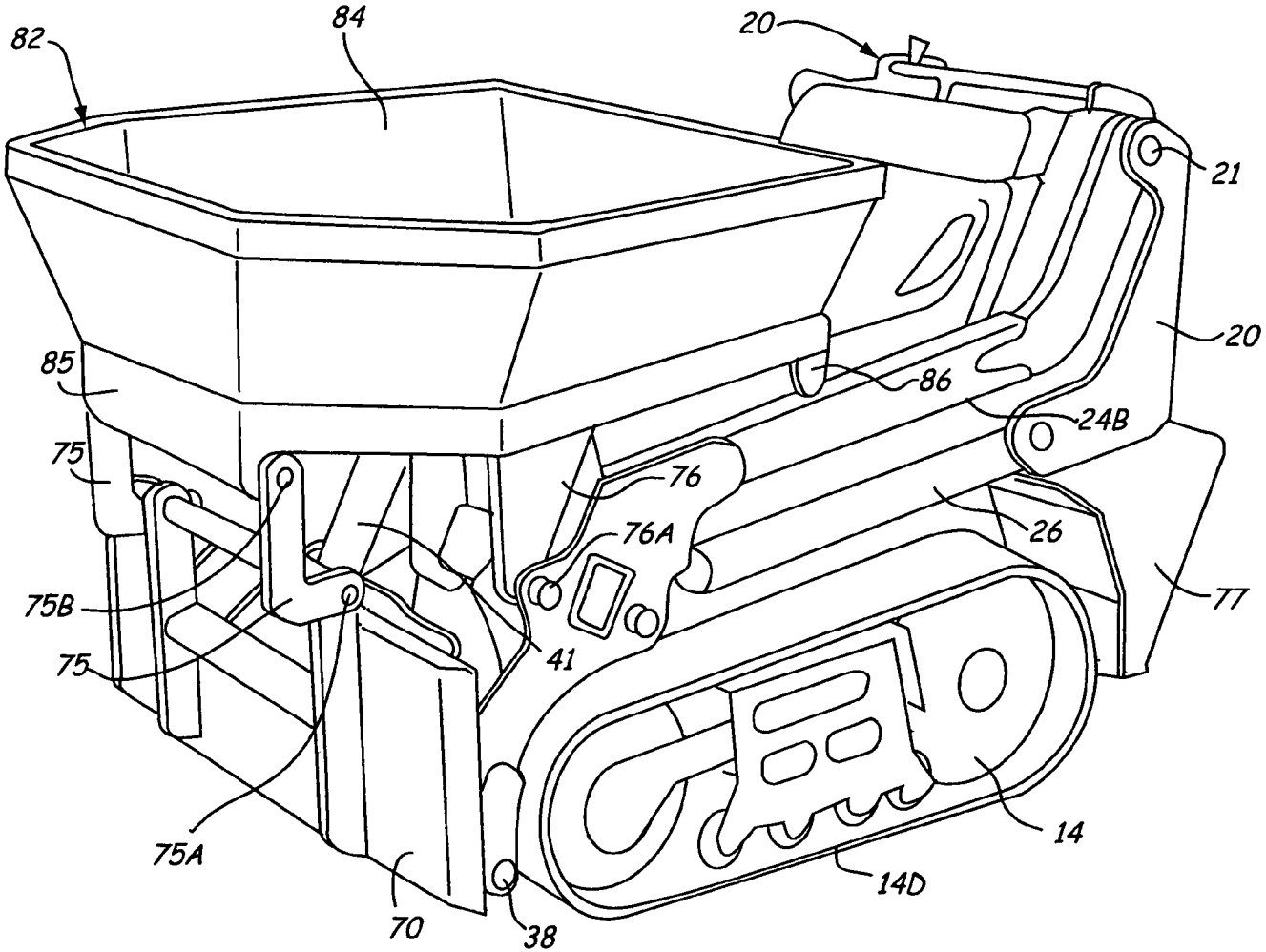
FIG. 15 is a perspective schematic view of a modified mounting for a hopper mounted on a small loader.

FIG. 15 shows a modified hopper 82, with a little higher sidewalls 84, than the wheelbarrow hopper shown in FIG. 14. The hopper 82 has a support frame 85 that is mounted in the same manner as the wheelbarrow hoppers 72 and 78, using the links 75, with pivots 75A and 75B for providing for pivotal mounting.

The brackets shown at 76 in FIG. 15 are attached to the frame 85, and the tilt cylinder 41 is again used for tilting the plate 70 and causing the hopper 82 to tilt forwardly as the tilt cylinder extends. Bumpers 86 are used for resting on the top of the lift arm 24A and 24B as previously shown. The hopper 82 will dump in the same manner as the wheelbarrow hopper shown in FIGS. 10-13.

Figure 16:
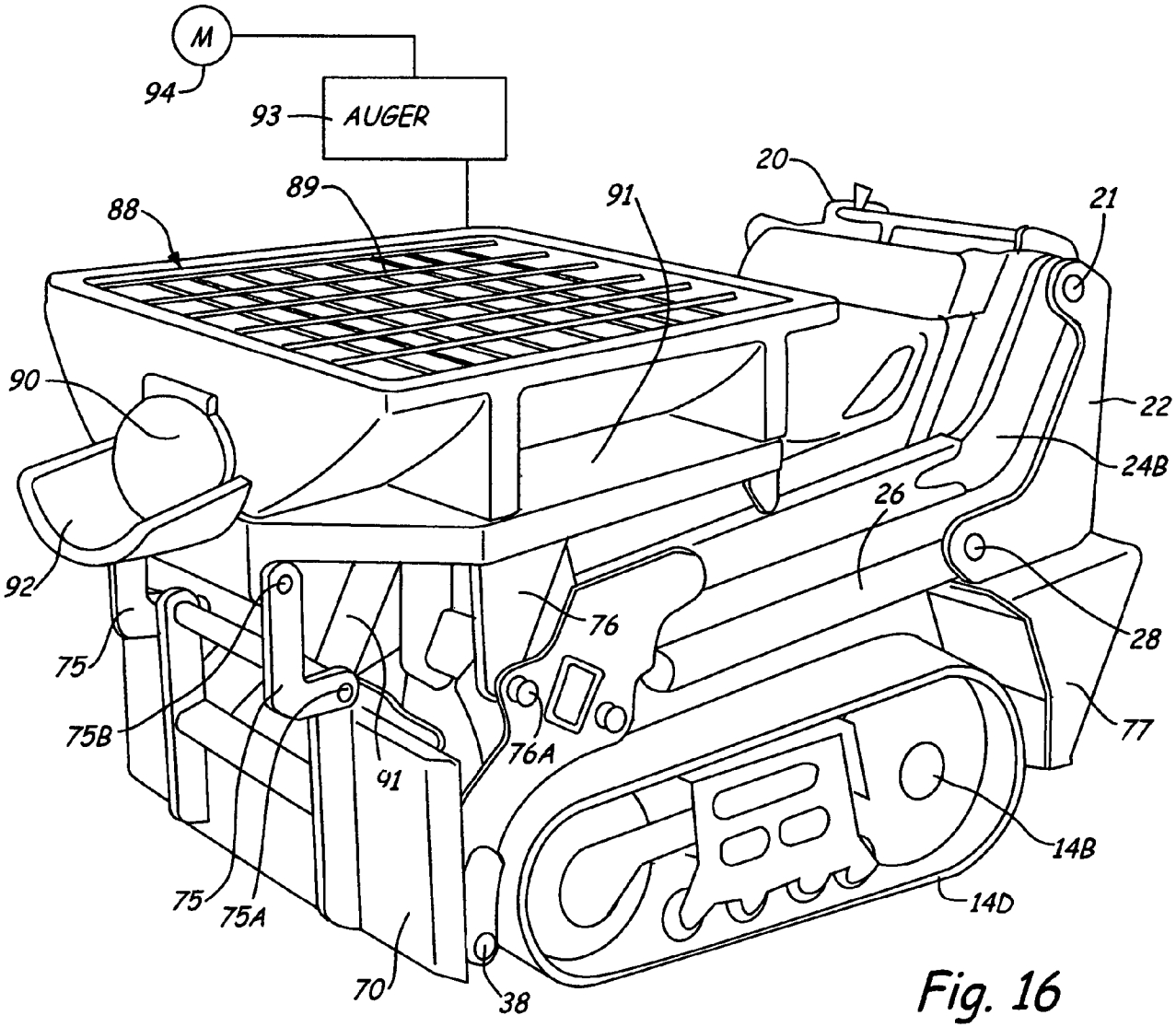
FIG. 16 is a schematic view similar to FIG. 15 showing a mixer hopper in position.

FIG. 16 illustrates a mixer hopper 88, which has an open screen cover 89 thereon, and the mixer has an internal auger 93 that will discharge material out through opening that is covered with a cover 90, and through a trough 92 onto the ground. The mixer hopper has a frame 91 that again has supports or links 76 that are pivotally mounted to the lift arms at pivot 76A, and the links 75 to the plate 70 are illustrated as well.

When tilt cylinder 41 is operated, the plate 70 will pivot on the pivot 38. The mixer hopper 88 can be dumped so that the material in the mixer hopper can be discharged through the covered opening 90 and trough 92 in a desired location.

Various materials can be mixed as desired, such as wet or dry materials, cattlefeed, fertilizer, silage, and other items that can be mixed with an auger.

In this form of the invention, the auger is represented at 93, and is mounted in the lower portion of the hopper, and a motor 94 drives the auger. The motor 94 is a hydraulic motor that can be driven from the hydraulic system of the loader, using auxiliary hydraulic connection from the pump 19 as driven by the engine 45.

Figure 17:
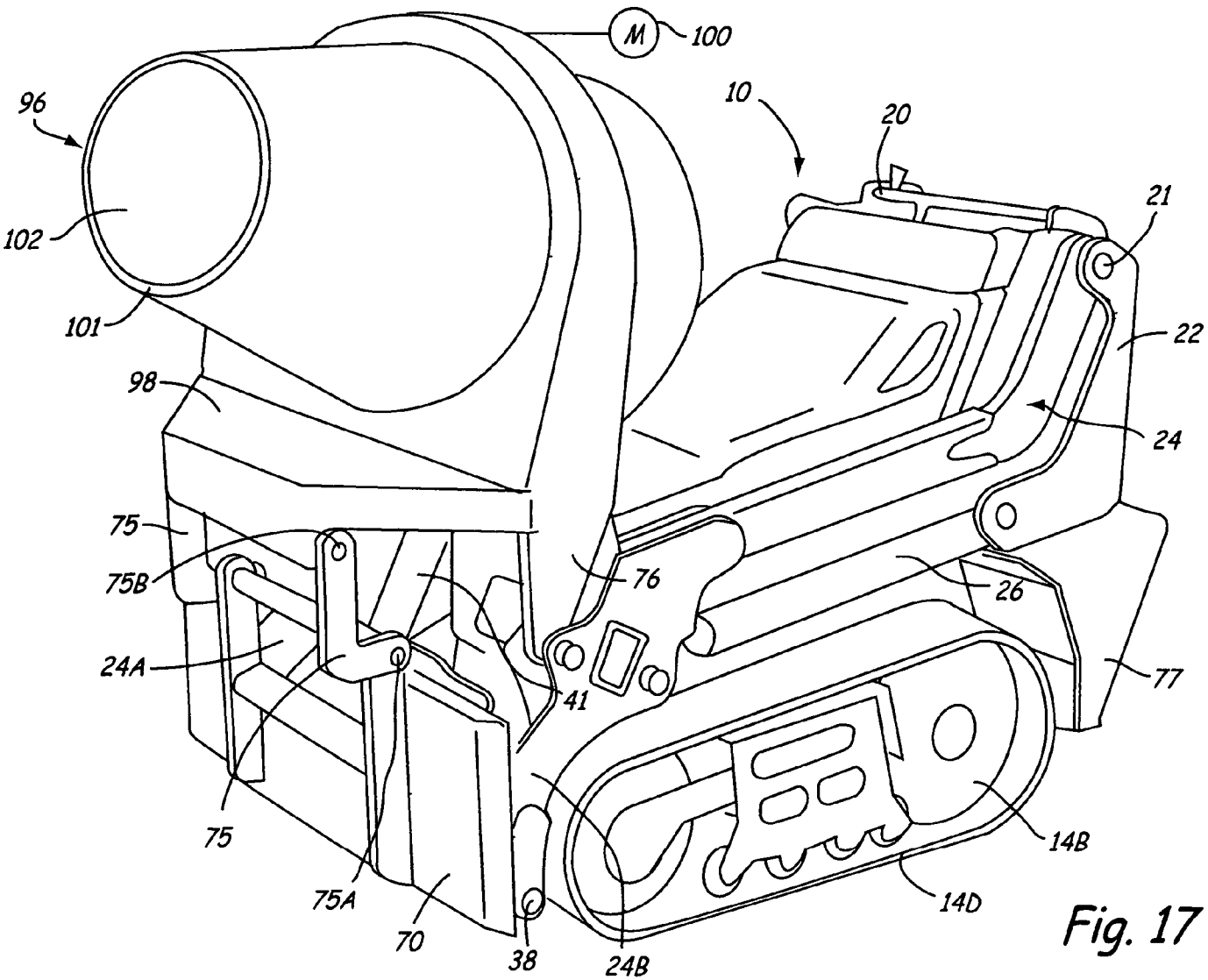
FIG. 17 is a schematic view of a loader having attachment linkages similar to FIG. 16 showing a concrete mixer in position on the loader.

FIG. 17 illustrates the loader 10 with a concrete mixer 96 mounted on a frame 98 that is in turn mounted on support struts 76 and links or supports 75. In this form of the invention, a motor 100 can be used for driving the mixer drum 101, and the motor 100 can be driven from the pump 19 and the engine 45 on the loader 10.

The drum 101 has an opening 102 through which material can be placed into the drum, for mixing, in a conventional manner. The opening 102 is also used for discharging the mixed concrete. This is done by operating the tilt cylinder 41 to tilt the plate 70 and through the links 75 and 76, cause the cement mixer drum to discharge material forwardly through the opening 102. The lift arm assembly 24 can be raised and lowered, as shown in FIGS. 10-13, for placing the concrete into the desired location.

Figure 18:
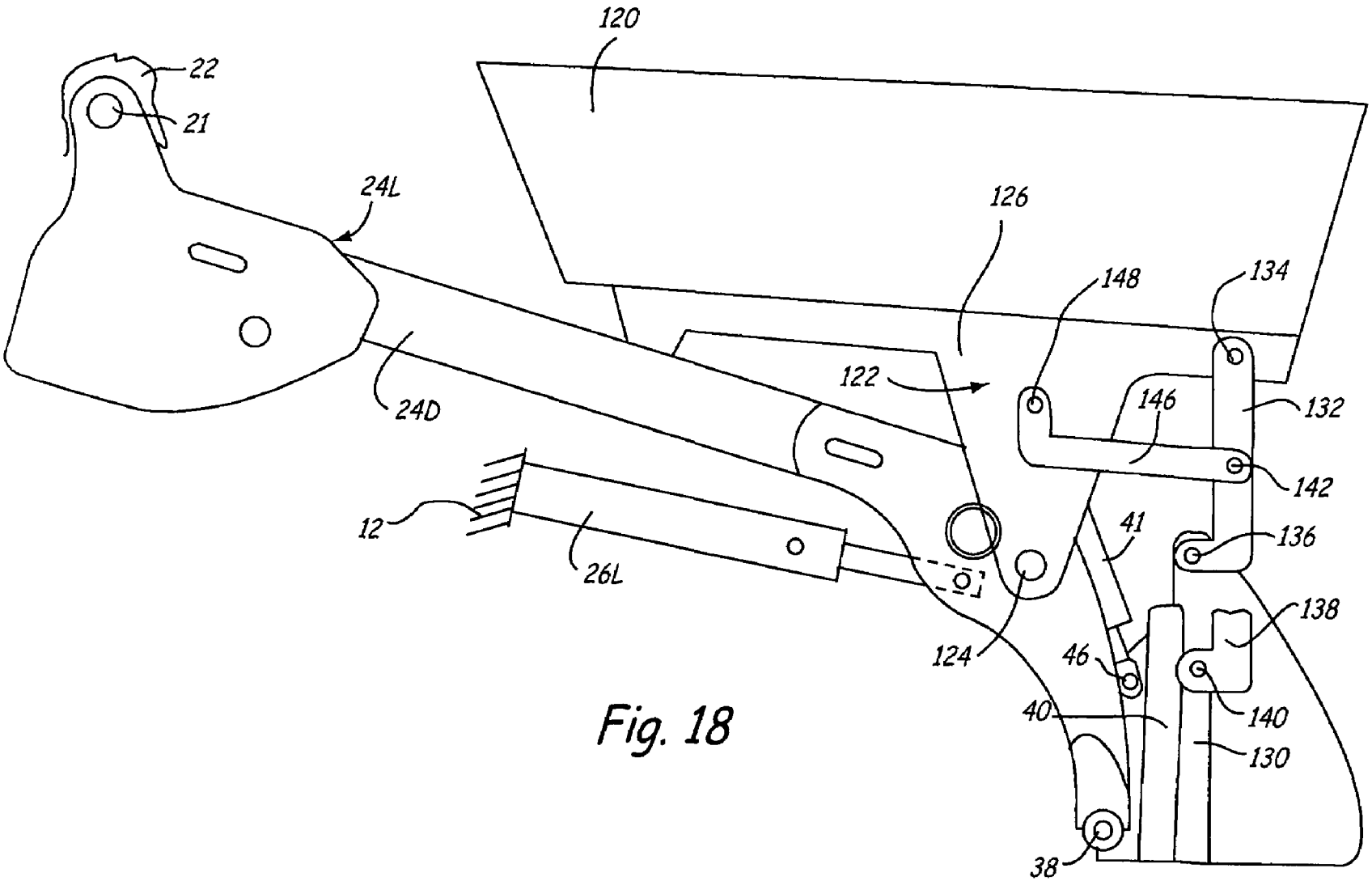
FIG. 18 is a schematic partial side view of a loader showing a linkage for controlling and locking a hopper into position.

A modified support and control system for a hopper is schematically shown in FIG. 18. FIG. 18 is a side view of a loader showing the lift arm 24D, which is part of lift arm assembly 24L, and which is mounted to supports 22, about a pivot 21, as previously explained. At the forward end of the lift arm assembly 24L, a regular "Bobtach" or quick attachment plate 40 is supported in the normal manner, and can be tilted with the tilt cylinder 41 as previously shown. The tilt cylinder 41 connects to the attachment plate 40 at a pivot point 46.

In this form of the invention, a hopper or tub 120 is supported on a support or frame 122, which is pivoted as at 124 directly to the lift arm assembly. The support 122 has depending brackets 126 forming part of the support 122. The control or pivoting of the support 122, and thus the hopper 120, about the pivot 124 is achieved with a series of linkages.

In this form of the invention, a mounting plate 130 is supported on the pivoting attachment plate 40, using the normal quick attachment levers and wedges. This mounting plate 130 has linkages connected thereto that are used for locking the hopper 120 in place as well as for controlling the pivotal movement of the hopper about the pivot 124. A first link 132 is pivotally mounted as at 134 to the support 120, which may be an integral part of the hopper. Link 132 is generally L-shaped, as are the other links that will be described, and the link is pivotally mounted at 136 to the upper end of the support plate 130.

A link 138 is the same length, and the same shape as link 132. Link 138 is shown broken away, but is pivotally mounted as at 140 to the support plate 130, at a level lower than pivot 136 and then also is pivotally mounted at a pivot 142 to the link 132.

A third identical locking link 146 is pivotally mounted at pivot 142, to the link 132 and 138 and extends rearwardly and is mounted onto the depending portion 126 of the support at the pivot 148. The link 146 is a removable lock link, or lever, and when it is in its position shown in FIG. 18 connected to pivot 142, the hopper 120 is locked in position and cannot pivot about the pivot 124. The hopper 120 can be raised and lowered with the lift arms 24L in this position.

Figure 19:
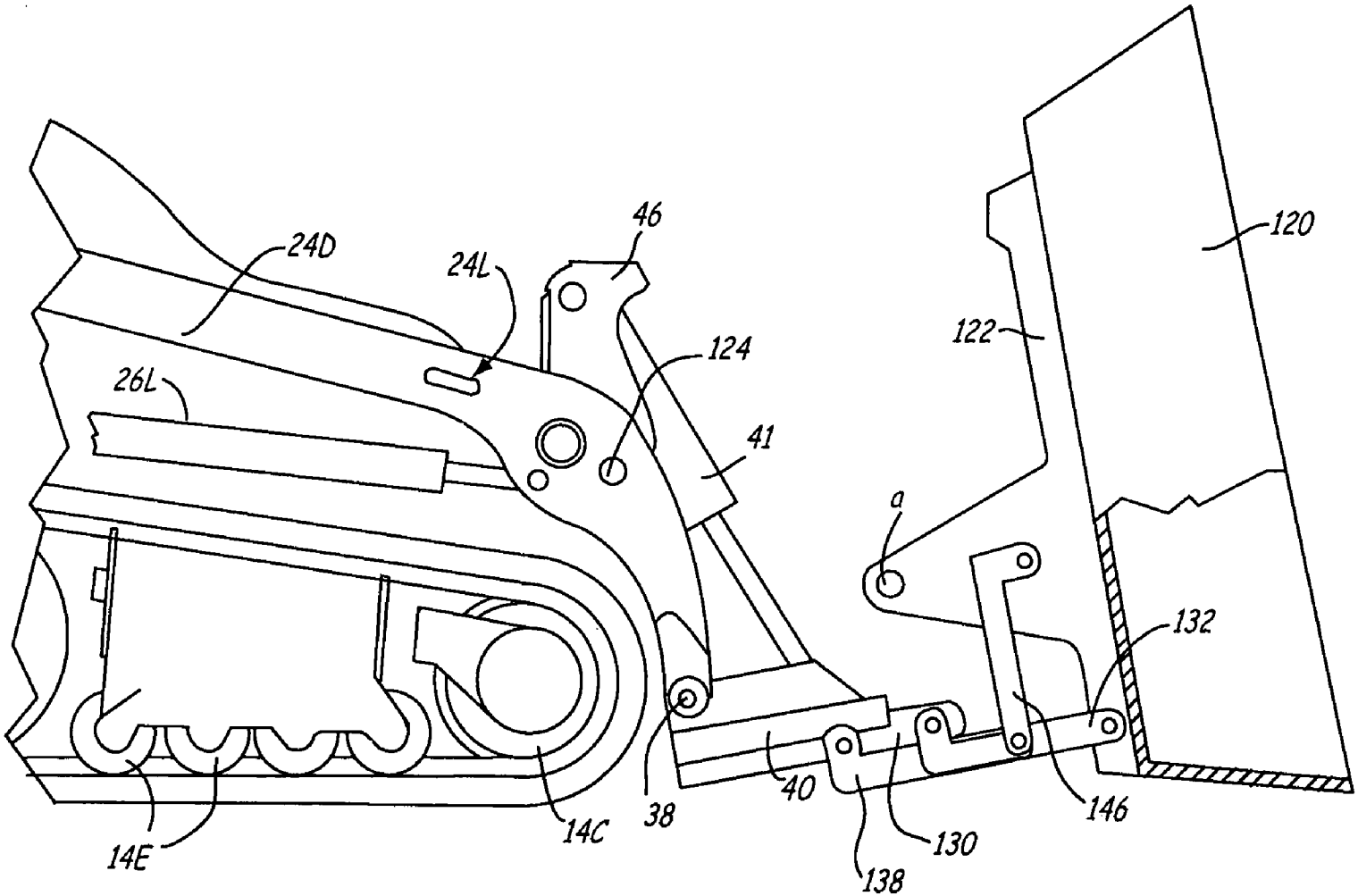
FIG. 19 is a view of the device of FIG. 18 with the hopper in a position where it can be left on the ground and removed from the loader.

When the pivot pin 124 is removed, however, the plate 130 can be moved with the plate 40 when operated with tilt cylinder 41, which is shown in FIG. 19. The linkages that were just described will hold the hopper 120 in position, so that the hopper can be pivoted down to put the front side shown at 150 onto the ground. Then, the plate 130 can be removed from the attachment plate 40 by moving the known quick attachment levers, that are conventional on the quick attachment plate 40, and disengaging the plate 130 from the quick attachment plate 40. The loader vehicle then can be moved away to leave the hopper attachment 120 rotated forward on the ground for storage. The plate 130 will form a type of a stabilizing support, so that the hopper will not tip over. Also, the plate 130 is close to the ground and can rest on the ground for stability.

If the hopper 120 is to be tilted or pivoted about its pivot 124, both of lock levers or links 146 and 138 are released at one or both of their respective pivots so they no longer lock the hopper from pivoting. The links 146 and 138 can be completely removed, if desired. When links 146 and 138 are released moving the tilt cylinder 41 causes plate 40 to pivot about pivot 38, pulling on links 132 so the hopper 120 pivots about the pivot 124 because it can then be pulled about pivot 124. The hopper 120 can be dumped at different heights as the lift arms 24L are raised.

Figure 20:
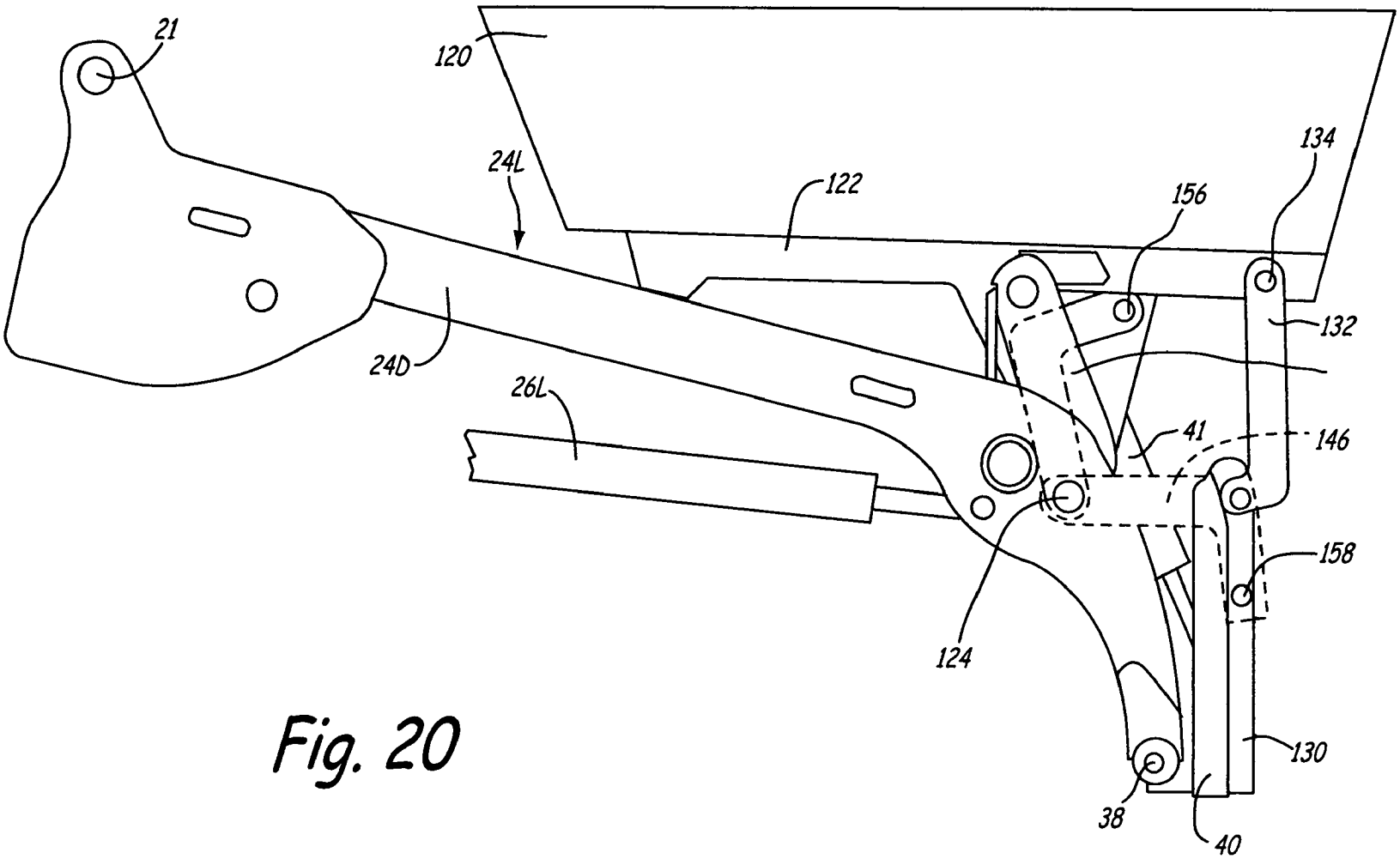
FIG. 20 is a side elevational view schematically showing an alternative locking lever to hold the hopper in a non-dumping position, which is movable to a position to permit dumping.
Figure 21:
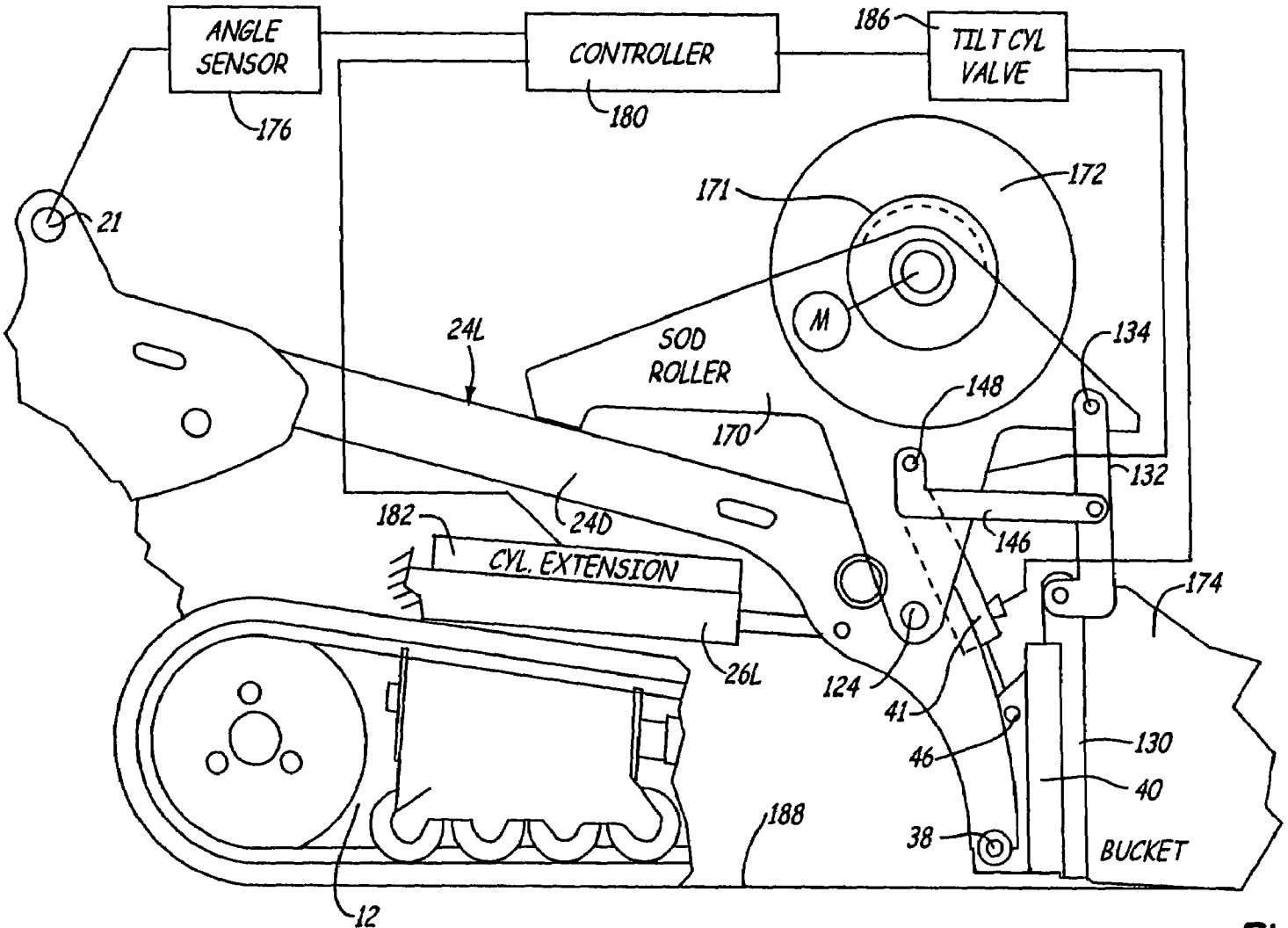
FIG. 21 is a side elevational view similar to FIG. 18 showing an alternate attachment supported on linkages.

In FIGS. 20 and 21, a single lock link or lever is shown. It can be seen that the lock link 146 is pivoted at pin 124 and can be moved to two different positions. The lock link 146 can be pinned as at 156 to the support for the hopper. The lever or link 146 is then in a storage position. The hopper can be pivoted about pivot, by operating the tilt cylinder.

Moving the lock lever or link 146 to a second position shown in dotted lines in FIG. 20, the lock lever 146 is pivoted down and mounted on a pivot pin 158 on the plate 13, which can have the same position as the pin 140, and this will lock the attachment plate 40 from pivoting, so the lock lever 146 will hold the hopper in a loading position.

FIG. 21 shows a modified form of the invention comprising a modified attachment. The lift arms, the attachment frame plates, and the other components are labeled as they were before, but in this case, a support frame 170 is used for supporting a sod roll core 171, that has a roll of sod 172 thereon, and as can be seen it is mounted rearwardly of the forward end of the lift arm assembly 24L and is supported on the lift arm assembly, at the pivot 124. The links 146 and 132 can be utilized in the same manner as before for locking the frame 170 in position relative to the pivot 124. The lock link 146 can be removed and the attachment plate 40 can be tilted so that it moves down adjacent to the ground, if the plate 130 is not supporting any additional accessory or attachment.

This form of the invention, a bucket 174 as shown on the plate 130, and it can be a second attachment that has a center of gravity forwardly of the lift arms, while the sod roller is positioned so it has a center of gravity to the rear of the front end of the lift arms. The positioning of the sod roller moves the center of gravity more over the loader frame.

In this form of the invention, controls are provided for maintaining the orientation of the sod roller or any other accessory supported on the frame 170, (or the frame 122 for the hopper 120 of previous form), as well as a bucket 174, oriented relative to the supporting surface 188 for the loader frame and the loader drive track or wheels. This can be done by utilizing suitable sensors for determining the position of the lift arm assembly 24L. Two different sensors are shown, one of which is an angle sensor 176 that is connected to sense the angle of the lift arm assembly 22L relative to the frame or some reference position. The sensor 176 provides a signal to a controller 180. Additionally, the extension of the lift cylinders 26L is sensed with a sensor 182 that provides a signal along a suitable line to the controller 180. The controller 180 in turn will operate the tilt cylinder valve 186, so that the tilt cylinder shown at 41, which is the same as in the first forms of the invention, will be operated to change the angle of the attachment plate 40, so that it remains oriented perpendicular to the supporting surface 188.

When the sod roller attachment is to be loaded, or even when operating, the lock link 146 can be released and the plate 40 tilted forwardly to be near or on the ground. This will lower the sod roller frame 170 so that a roll of sod can be loaded onto the frame work 170 easily.

Again, the showing in FIG. 21 also illustrates the use of two different attachments, one on the regular attachment plate 40, as augmented by the plate 130, which is removable easily. The bucket can be mounted on the plate 130 in the same way that it is now mounted onto the Bobtach attachment plates on skid steer loaders.

Thus, the present invention provides for mounting material holding hopper type accessories or attachments to the lift arms. The hopper can be moved by operation of either the lift arms themselves, as shown in FIG. 3, or using the tilt cylinder 41, as shown in other figures, to tilt the hopper that has the hopper chamber, and cause dumping the materials in the hopper chamber where desired. The various configurations of the links can be made in order to accomplish the purposes of mounting containers, tubs, or the like on the lift arms and dumping them through the use of links or existing hydraulic cylinders on the small loader.

The need for powering motors to drive mixers is fulfilled by the auxiliary hydraulic system on the small loader, so that the loader itself provides power for the motors necessary for the attachments.

A single lift arm can be used on the loader, rather than the dual lift arms connected with a cross tube, as shown herein.

Other attachments, such as a sod roller, or other normal attachment for skid steer loaders, sized to be appropriate for the loader illustrated can be mounted center portions of the lift arms, rather than on the front ends of the lift arms. The other attachment on the arms rearwardly of the front end. Dual attachments also can be used on the loaders one at the forward end of the lift arms and so that the center of gravity of an attachment forward of the lift arms, can be counterbalanced by another attachment to move the center of gravity more over the machine. The hinge axis of the hopper can be on the lift arm assembly, as shown in FIGS. 18 and 19. The tilt cylinder does not have to be at the location illustrated in the Figures either, but can be moved to the edges of the attachment plate.

In connection with FIGS. 3 and 4, the lift arms are used for the raising and lowering to dump the lift arm mounted attachments. This uses the existing lift cylinder for the dumping action, and the dumping height therefore is not variable, because the lift arms will cause dumping as they raise.

The basic features include the ability to change the angle of the attachment, such as a hopper, with respect to the support surface by the linkage. The control linkage can be used with any type of an attachment. Then, using the relative motion of the existing front end attachment interface, or quick attachment plate with respect to the lift arms, the container or other attachments supported on a frame on the lift arms can be tilted.

Raising and lowering of the lift arms can be completed independently of the attachment tilting, as shown in the drawings.

The existing and known bucket leveling controls can be utilized as well by correlating the movement of the lift arm relative to the ground, or the angle of the lift arm relative to the frame. The extension of the lift arm cylinder also can be correlated to position the lift arms.

Although the present invention has been described with reference to preferred embodiments, workers skilled in the art will recognize that changes may be made in form and detail without departing from the spirit and scope of the invention.

What is claimed is:

1. A small loader comprising a frame adapted for movement over a supporting surface, the frame having at least one lift arm thereon that is pivotally mounted to the frame and has an outer forward end that is raisable and lowerable under power, a first attachment being attached to the at least one lift arm at a pivotal mounting thereon adjacent and to the rear of the outer forward end of the at least one lift arm such that the center of gravity of the first attachment is located at its rearmost position and located rearwardly of the outer forward end of the at least one lift arm with the at least one lift arm in a lowered position.

2. The loader of claim 1, wherein the at least one lift arm comprises a support at the outer forward end thereof, and a second attachment mounted to the support.

3. The loader of claim 1, wherein said first attachment comprises one of a group of attachments including a cement mixer, an auger mixer, a sod roller, and an open top hopper.

4. The loader of claim 3, wherein a tiltable plate is pivotally mounted at the outer forward end of the at least one lift arm, a link connected between the attachment and the tiltable plate, and wherein tilting the tiltable plate causes pivoting of the attachment relative to the at least one lift arm.

5. The loader of claim 1, wherein there is a linkage connected between the first attachment and the frame of the loader and wherein moving the at least one lift arm about a pivot relative to the frame causes the attachment to tilt relative to the at least one lift arm.

6. The loader of claim 1, wherein said first attachment comprises a working body, and a support integral with the working body for pivotally mounting to portions of the at least one lift arm.

7. The loader of claim 1, wherein the first attachment is attached to the at least one lift arm without being attached to the frame such that the lift arm can be moved to raise or lower the first attachment without a change in relative position between the first attachment and the at least one lift arm.

8. The loader of claim 1, wherein the at least one lift arm has a tilting attachment plate at the forward end thereof coupled to the first attachment, a power operator connected between the at least one lift arm and the tilting attachment plate, and wherein there is a sensor for sensing movement of the at least one lift arm relative to the frame, said sensor causing the power operator of the tilting attachment plate to change position to maintain the orientation of the first attachment relative to a supporting surface as the at least one lift arm is raised and lowered.

9. The loader of claim 1, further comprising a pivoting plate having a lower edge pivotally mounted at a plate pivot to the at least one lift arm, and being movable about the plate pivot, a first linkage connected between the first attachment and the pivoting plate, the first linkage causing pivoting of the first attachment when an upper edge of the pivoting plate is rotated forwardly about the plate pivot.

10. The loader of claim 9, further comprising a locking linkage removably connected to the first attachment and to the pivoting plate to prevent pivotal movement of the first attachment relative to the at least one lift arm, the locking linkage being removable to permit pivoting the first attachment forwardly by pivoting the pivoting plate to a position where the first attachment rests on the ground, and the pivoting plate can be disconnectable from the at least one lift arm.

11. The loader of claim 1, wherein the first attachment comprises a hopper and a stop bumper on a rear portion of the hopper aligned with a portion of the at least one lift arm to engage such portion and stop rearward pivotal movement of the hopper.

12. A work attachment comprising a mounting connectable to a loader arm, the loader arm being pivotally attached to and movable relative to a loader frame, the mounting comprising a support having a first pivot mount for operable pivotal mounting to the loader arm and a second pivot mount for operable pivotal connection to a solid link mechanism, the solid link mechanism operably pivotally connected to the support at a first end proximate to a forward end of the support and adaptable to be pivotally mounted onto a portion of the loader frame at a second end, the first pivot mount being positionable on the loader arm rearward of the portion of the loader frame and forward of the pivotal attachment of the loader arm to the loader frame, and the portion of the loader frame and the first pivot mount being movable relative to each other when the first pivot mount is mounted on the loader arm.

13. The work attachment of claim 12, wherein the first pivot mount is positioned forwardly of a rear portion of the support, whereby portions of the support extend rearwardly from the first pivot mount when mounted on the loader arm.

14. The work attachment of claim 12, wherein the attachment is an open top receptacle, and wherein the solid link mechanism controls pivotal movement of the open top receptacle on the first pivot mount to pivot the open top receptacle in a forward direction and dump material from the receptacle over a forwardly extending end of the open top receptacle when the loader arm is raised.

15. The work attachment of claim 12, wherein the loader arm has an outer end that is raiseable and lowerable, and wherein the portion of the loader pivotally connectable to said solid link mechanism is pivotally connected to the portion of the loader and such portion does not raise and lower with the loader arm.

16. The work attachment of claim 13 further comprising a stop bumper on the rear portion of the support, the stop bumper positioned to engage a portion of the loader arm on which the support is mountable to stop pivotal movement about the first pivot mount in one direction of pivotal movement.

17. A work attachment for a loader having a loader frame and a loader arm, the loader arm being pivotally attached to and movable relative to the loader frame, the work attachment comprising a mounting connectable to the loader arm and comprising a support having a first pivot mount for operable pivotal mounting to the loader arm and a second pivot mount for operable pivot connection to a solid link mechanism, the solid link mechanism operably pivotally connected to the support at a first end proximate to a forward end of the support and adaptable to be pivotally mounted onto a portion of the loader at a second end, the first pivot mount being positionable on the loader arm rearward of the portion of the loader and forward of the pivotal attachment of the loader arm to the loader frame, and the portion of the loader and the first pivot mount being movable relative to each other when the first pivot mount is mounted on the loader arm, to cause pivoting of the support about the first pivot mount.

18. The work attachment of claim 17, wherein the work attachment comprises an open topped container mounted on the support for movement with loader arm.

19. The work attachment of claim 17, wherein the work attachment comprises a container on the support the container being movable with the support.

20. The work attachment of claim 19, wherein said container comprises a cement mixer.

21. The work attachment of claim 19, wherein said container comprises an auger mixer and has an open top, and a discharge trough at a forward end of the container.

22. The work attachment of claim 17, wherein the work attachment is selected from a group consisting of an auger mixer, a cement mixer, a hopper, and a sod roller.

23. The work attachment of claim 17, wherein the second end of the solid link mechanism is connectable to a tilting attachment plate located at a forward end of the loader arm and comprising the portion of the loader, and wherein the tilting attachment is coupled to an actuator for moving said tilting attachment plate relative to the first pivot mount.

24. The work attachment of claim 23, wherein the loader arm has an outer end that is raisable and lowerable, and said tilting attachment plate moves with said loader arm, and the support has an attachment mounted to it comprising an open top receptacle that is pivoted when the tilting attachment plate is tilted to cause the open top receptacle to dump over a forward end thereof. which the support is mountable to stop pivotal movement about the first pivot mount in one direction of pivotal movement.

25. The work attachment of claim 17, further comprising an attachment plate coupled to an end of the loader arm and comprising the portion of the loader, wherein the second end of the solid link mechanism is adaptable to be pivotally mounted onto the attachment plate.

* * * * *

UNITED STATES PATENT AND TRADEMARK OFFICE

CERTIFICATE OF CORRECTION

PATENT NO. : 7,494,314 B2
APPLICATION NO. : 10/693617
DATED : February 24, 2009
INVENTOR(S) : Mark F. Bares et al.

It is certified that error appears in the above-identified patent and that said Letters Patent is hereby corrected as shown below:

In the Claims -

Claim 24 (In Col. 12, line 29-31) - Please delete "which the support is moutable to stop pivotal movement about the first pivot mount in one direction of pivotal movement."

Signed and Sealed this
Eleventh Day of January, 2011

David J. Kappos

David J. Kappos
*Director of the United States Patent and Trademark Office*